US007938199B2

(12) United States Patent
Welshans et al.

(10) Patent No.: US 7,938,199 B2
(45) Date of Patent: May 10, 2011

(54) MEASUREMENT WHILE DRILLING TOOL WITH INTERCONNECT ASSEMBLY

(75) Inventors: David Welshans, Damon, TX (US); Kristopher V. Sherrill, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 135 days.

(21) Appl. No.: 12/303,452

(22) PCT Filed: Jun. 8, 2007

(86) PCT No.: PCT/US2007/070756

§ 371 (c)(1),
(2), (4) Date: Dec. 4, 2008

(87) PCT Pub. No.: WO2007/146801

PCT Pub. Date: Dec. 21, 2007

(65) Prior Publication Data

US 2009/0195250 A1 Aug. 6, 2009

Related U.S. Application Data

(60) Provisional application No. 60/804,405, filed on Jun. 9, 2006.

(51) Int. Cl.
*E21B 49/10* (2006.01)

(52) U.S. Cl. ..... 175/59; 166/264; 166/100

(58) Field of Classification Search ..... 175/48, 175/59; 166/264.1

See application file for complete search history.

(56) References Cited

U.S. PATENT DOCUMENTS

| | | | | |
|---|---|---|---|---|
| 3,430,181 | A * | 2/1969 | Urbanosky | 439/194 |
| 6,301,959 | B1 | 10/2001 | Hrametz et al. | |
| 2008/0245570 | A1 * | 10/2008 | Partouche | 175/48 |

FOREIGN PATENT DOCUMENTS

| | | | |
|---|---|---|---|
| CA | 2485822 | A1 | 12/2003 |
| CA | 2549113 | A1 | 12/2006 |
| EP | 0953726 | A1 | 11/1999 |

OTHER PUBLICATIONS

Canadian Application No. 2,651,054 Office Action dated Dec. 6, 2010.

* cited by examiner

*Primary Examiner* — William P Neuder
(74) *Attorney, Agent, or Firm* — Conley Rose, P.C.

(57) ABSTRACT

An embodiment of the apparatus includes a first drill collar section having an outer surface, an MWD tool for interaction with an earth formation coupled to the first drill collar section, the MWD tool including a first fluid line and a first electrical conduit, a second drill collar section, and an interconnect assembly coupling the second drill collar section to the first drill collar section, the interconnect assembly comprising a fluid line connection coupled to the first fluid line and an electrical connection coupled to the first electrical conduit. Another embodiment of the apparatus includes a probe, an interconnect assembly adapted for fluid communication and electrical communication, and a sample bottle drill collar section including at least one removable sample bottle in fluid communication with the probe. Another embodiment of the apparatus includes a flush pump mounted in the power collar section and coupled to the probe. An additional embodiment includes a fluid ID sensor disposed in a flow line between the flush pump and the probe.

38 Claims, 18 Drawing Sheets

MEASUREMENT WHILE DRILLING TOOL WITH INTERCONNECT ASSEMBLY

This application claims the benefit of U.S. Provisional Application Ser. No. 60/804,405, filed Jun. 9, 2006 and entitled "LWD Fluid Identifier."

BACKGROUND

During the drilling and completion of oil and gas wells, it may be necessary to engage in ancillary operations, such as monitoring the operability of equipment used during the drilling process or evaluating the production capabilities of formations intersected by the wellbore. For example, after a well or well interval has been drilled, zones of interest are often tested to determine various formation properties such as permeability, fluid type, fluid quality, fluid density, formation temperature, formation pressure, bubble point, formation pressure gradient, mobility, filtrate viscosity, spherical mobility, coupled compressibility porosity, skin damage (which is an indication of how the mud filtrate has changed the permeability near the wellbore), and anisotropy (which is the ratio of the vertical and horizontal permeabilities). These tests are performed in order to determine whether commercial exploitation of the intersected formations is viable and how to optimize production.

Tools for evaluating formations and fluids in a well bore may take a variety of forms, and the tools may be deployed down hole in a variety of ways. For examples the evaluation tool may be a formation tester having an extendable sampling device, or probe, and pressure sensors, or the tool may be a fluid identification (ID) tool. The evaluation tool may also include sensors and assemblies for taking nuclear measurements. The evaluation tool may further include assemblies or devices which require hydraulic power. For example, the tool may include an extendable density pad, an extendable coring tool, or an extendable reamer. Other examples of hydraulically powered devices useful in downhole evaluation tools are known to one skilled in the art.

Often times an evaluation tool is coupled to a tubular, such as a drill collar, and connected to a drill string used in drilling the borehole. Thus, evaluation and identification of formations and fluids can be achieved during drilling operations. Such tools are typically called measurement while drilling (MWD) or logging while drilling (LWD) tools. As previously suggested, the tool may include any combination of a formation tester, a fluid ID device, a hydraulically powered device, or any number of other MWD devices as one of skill in the art would understand. As these tools continue to be developed, the functionality, size and complexity of these tools continue to increase. Consequently, multiple tools having different devices and functions may be placed in multiple drill collars. For example, as many as four or more drill collars extending over 40 feet may be needed. The desire to use multiple tools or systems spread over multiple tubular sections in a drilling environment while maintaining the connectability and interchangeability of the tools, as well as the many electrical and fluid connections between the tools, is pushing the limits of current downhole evaluation and identification tools. Further, directly measuring and identifying fluids in such tools becomes increasingly difficult.

SUMMARY

An embodiment of the apparatus includes a first drill collar section having an outer surface, an MWD tool for interaction with an earth formation coupled to the first drill collar section, the MWD tool including a first fluid line and a first electrical conduit, a second drill collar section, and an interconnect assembly coupling the second drill collar section to the first drill collar section, the interconnect assembly comprising a fluid line connection coupled to the first fluid line and an electrical connection coupled to the first electrical conduit.

Another embodiment of the apparatus includes a probe drill collar section having an outer surface and a probe to extend beyond the outer surface and toward an earth formation to receive formation fluids, a power drill collar section having a power source and an electronics module, an interconnect assembly coupling the power collar section to the probe collar section, the interconnect assembly adapted for fluid communication and electrical communication, and a sample bottle drill collar section coupled to the power collar section, the sample bottle collar section including at least one removable sample bottle in fluid communication with the probe.

Another embodiment of the apparatus includes a probe drill collar section having an outer surface and a probe to extend beyond said outer surface and toward an earth formation to receive formation fluids, a power drill collar section having a power source and an electronics module, an interconnect assembly coupling the power collar section to the probe collar section, the interconnect assembly adapted for fluid communication and electrical communication, and a flush pump mounted in the power collar section and coupled to the probe. An additional embodiment includes a fluid ID sensor disposed in a flow line between the flush pump and the probe.

BRIEF DESCRIPTION OF THE DRAWINGS

For a detailed description of exemplary embodiments of the invention, reference will now be made to the accompanying drawings in which.

DETAILED DESCRIPTION

Figure 1:
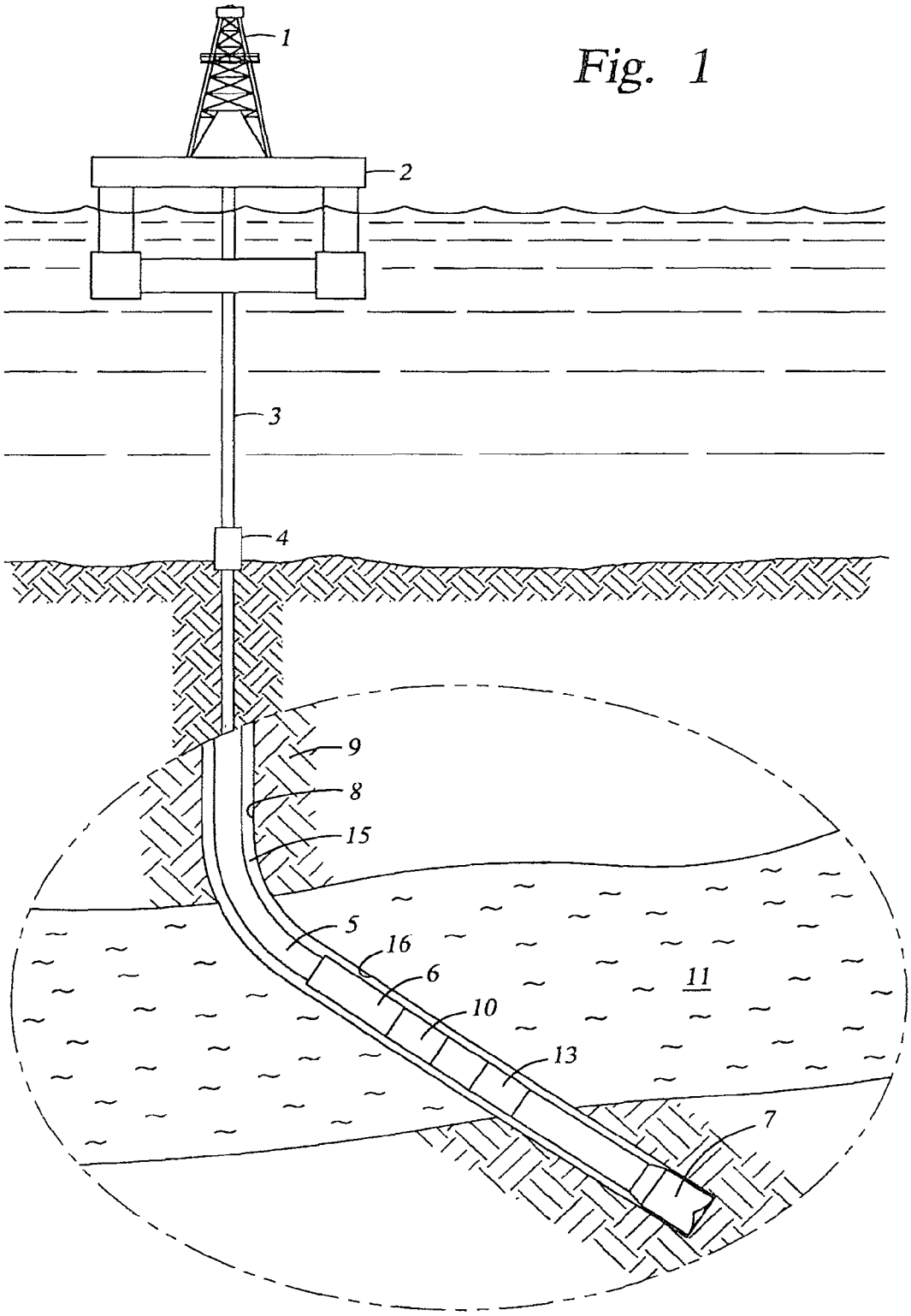
FIG. 1 is a schematic elevation view, partly in cross-section, of an embodiment of a drilling and MWD apparatus disposed in a subterranean well.

In the drawings and description that follows, attempts are made to mark like parts throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Unless otherwise specified, any use of any form of the terms "connect", "engage", "couple", "attach", or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. In addition, in the discussion and claims that follow, it may be sometimes stated that certain components or elements are in fluid communication. By this it is meant that the components are constructed and interrelated such that a fluid could be communicated between them, as via a passageway, tube, or conduit. Also, the designation "MWD" or "LWD" are used to mean all generic measurement while drilling or logging while drilling apparatus and systems. The various characteristics mentioned above, as well as other features and characteristics described in more detail below, will be readily apparent to those skilled in the art upon reading the following detailed description of the embodiments, and by referring to the accompanying drawings.

Referring initially to FIG. 1, a MWD formation evaluation or formation fluid identification tool 10 is shown schematically as a part of bottom hole assembly 6 which includes an MWD sub 13 and a drill bit 7 at its distal most end. The bottom hole assembly 6 is lowered from a drilling platform 2, such as a ship or other conventional platform, via a drill string 5. The drill string 5 is disposed through a riser 3 and a well head 4. Conventional drilling equipment (not shown) is supported within a derrick 1 and rotates the drill string 5 and the drill bit 7, causing the bit 7 to form a borehole 8 through the formation material 9. The borehole 8 penetrates subterranean zones or reservoirs, such as reservoir 11, that are believed to contain hydrocarbons in a commercially viable quantity. It is also consistent with the teachings herein that the MWD tool 10 is employed in other bottom hole assemblies and with other drilling apparatus in land-based drilling with land-based platforms, as well as offshore drilling as shown in FIG. 1. In all instances, in addition to the MWD tool 10, the bottom hole assembly 6 contains various conventional apparatus and systems, such as a down hole drill motor, a rotary steerable tool, a mud pulse telemetry system, MWD or LWD sensors and systems, and others known in the art.

Although the various embodiments described herein primarily depict a drill string, it is consistent with the teachings herein that the MWD tool 10 and other components described herein may be conveyed down borehole 8 via wireline technology or a rotary steerable drill string.

Figure 2:
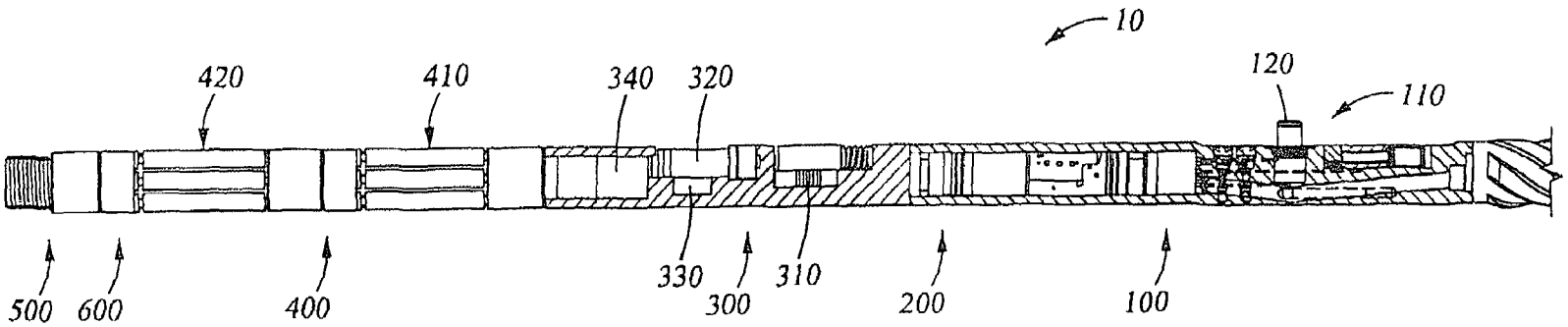
FIG. 2 is a partial schematic and partial cross-section view of one embodiment of a MWD tool.

Referring now to FIG. 2, an exemplary embodiment of the tool 10 is shown. A first end of the tool 10 includes a first drill collar section 100, also called the probe drill collar section 100. For reference purposes, the first end of the tool 10 at the probe collar section 100 is generally the lowermost end of the tool, which is closest to the distal end of the borehole 8. The probe collar section 100 includes a formation tester or formation probe assembly 110 having an extendable sample device or extendable probe 120. The tool 10 includes a second drill collar section 300, also called the power drill collar section 300, coupled to the probe collar section 100 via an interconnect assembly 200. As will be described herein, the interconnect assembly 200 includes fluid and power/electrical passthrough capabilities such that the various connections in the interconnect assembly are able to communicate, for example, electrical signals, power, formation fluids, hydraulic fluids and drilling fluids to and from the probe collar 100 and the power collar 300.

Power collar 300 includes certain components such as a flush pump assembly 310, a flow gear or turbine assembly 320, an electronics module 330 and a drilling fluid flow bore diverter 340. Coupled to the power collar 300 is a third drill collar section 400, also called the sample bottle drill collar section 400. The sample bottle collar 400 may include one or more sample bottle assemblies 410, 420. Coupled to the sample bottle collar 400 is a fourth drill collar section 500, also called the terminator drill collar section 500. The coupling between the sample bottle collar 400 and the terminator collar 500 may include another embodiment of an interconnect assembly-interconnect assembly 600. Alternatively, the terminator collar 500 and the interconnect assembly 600 couple directly to the power collar 300 if a sample bottle collar 400 is not needed.

Figure 3:
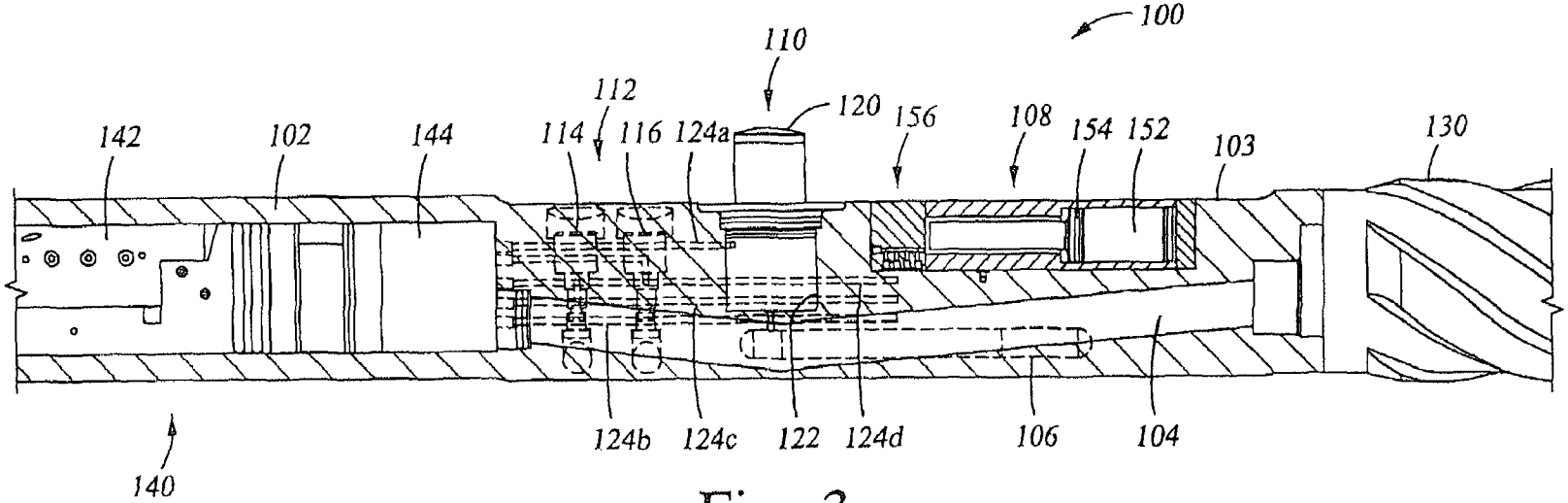
FIG. 3 is a partial schematic and partial cross-section view of one embodiment of a probe drill collar section of the MWD tool of FIG. 2.

Referring next to FIG. 3, an embodiment of the probe collar section 100 is shown in more detail. A drill collar 102 houses the formation tester or probe assembly 110. The probe assembly 110 includes various components for operation of the probe assembly 110 to receive and analyze formation fluids from the earth formation 9 and the reservoir 11. The probe member 120 is disposed in an aperture 122 in the drill collar 102 and extendable beyond the drill collar 102 outer surface, as shown. The probe member 120 is retractable to a position recessed beneath the drill collar 102 outer surface, as shown in FIG. 4. The probe assembly 110 may include a recessed outer portion 103 of the drill collar 102 outer surface adjacent the probe member 120. The probe assembly 110 includes a draw down piston assembly 108, a sensor 106, a valve assembly 112 having a flow line shutoff valve 114 and equalizer valve 116, and a drilling fluid flow bore 104. At one end of the probe collar 100, generally the lower end when the tool 10 is disposed in the borehole 8, is an optional stabilizer 130, and at the other end is an assembly 140 including a hydraulic system 142 and a manifold 144.

The draw down piston assembly 108 includes a piston chamber 152 containing a draw down piston 154 and a manifold 156 including various fluid and electrical conduits and control devices, as one of ordinary skill in the art would understand. The draw down piston assembly 108, the probe 120, the sensor 106 (e.g., a pressure gauge) and the valve assembly 112 communicate with each other and various other components of the probe collar 100, such as the manifold 144 and hydraulic system 142, and the tool 10 via conduits 124*a*, 124*b*, 124*c* and 124*d*. The conduits 124*a*, 124*b*, 124*c*, 124*d* include various fluid flow lines and electrical conduits for operation of the probe assembly 110 and probe collar 100, as one of ordinary skill in the art would understand.

For example, one of conduits 124*a*, 124*b*, 124*c*, 124*d* provides a hydraulic fluid to the probe 120 to extend the probe 120 and engage the formation 9. Another of these conduits provides hydraulic fluid to the draw down piston 154, actuating the piston 154 and causing a pressure drop in another of these conduits, a formation fluid flow line to the probe 120. The pressure drop in the flow line also causes a pressure drop in the probe 120, thereby drawing formation fluids into the probe 120 and the draw down piston assembly 108. Another of the conduits 124*a*, 124*b*, 124*c*, 124*d* is a formation fluid flow line communicating formation fluid to the sensor 106 for measurement, and to the valve assembly 112 and the manifold 144. The flow line shutoff valve 114 controls fluid flow through the flow line, and the equalizer valve 116 is actuatable to expose the flow line the and probe assembly 110 to a fluid pressure in an annulus surrounding the probe collar 100, thereby equalizing the pressure between the annulus and the probe assembly 110. The manifold 144 receives the various conduits 124*a*, 124*b*, 124*c*, 124*d*, and the hydraulic system 142 directs hydraulic fluid to the various components of the probe assembly 110 as just described. One or more of the conduits 124*a*, 124*b*, 124*c*, 124*d* are electrical for communicating power from a power source, described elsewhere herein, and control signals from a controller in the tool, also described elsewhere herein, or from the surface of the well.

Drilling fluid flow bore 104 may be offset or deviated from a longitudinal axis of the drill collar 102, as shown in FIG. 3, such that at least a portion of the flow bore 104 is not central in the drill collar 102 and not parallel to the longitudinal axis. The deviated portion of the flow bore 104 allows the receiving aperture 122 to be placed in the drill collar 102 such that the probe member 120 can be fully recessed below the drill collar 102 outer surface. As seen in FIG. 3, space for formation testing and other components is limited. Drilling fluid must also be able to pass through the probe collar 100 to reach the drill bit 7. The deviated or offset flow bore 104 allows an extendable sample device such as probe 120 and other probe embodiments described herein to retract and be protected as needed, and also to extend and engage the formation for proper formation testing.

Figure 4A:
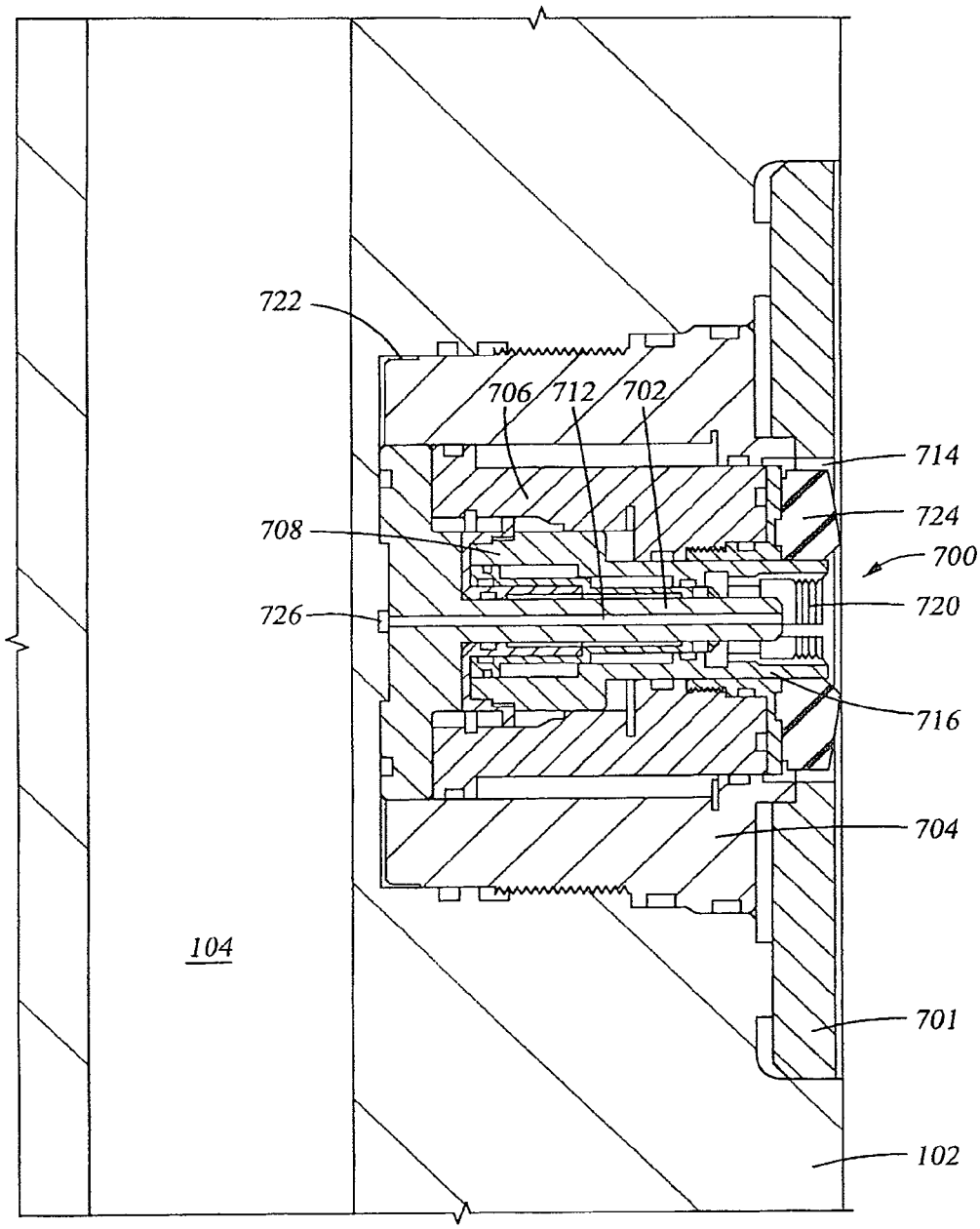
FIG. 4A is a cross-section view of one embodiment of the probe of FIG. 3.

Referring now to FIG. 4A, an alternative embodiment to probe 120 is shown as probe 700. The probe 700 is retained in an aperture 722 in drill collar 102 by threaded engagement and also by cover plate 701 having aperture 714. Alternative means for retaining the probe 700 are consistent with the teachings herein, as one of ordinary skill in the art would understand. The probe 700 is shown in a retracted position, beneath the outer surface of the drill collar 102. The probe 700 generally includes a stem 702 having a passageway 712, a sleeve 704, a piston 706 adapted to reciprocate within the sleeve 704, and a snorkel assembly 708 adapted for reciprocal movement within the piston 706. The snorkel assembly 708 includes a snorkel 716. The end of the snorkel 716 may be equipped with a screen 720. Screen 720 may include, for example, a slotted screen, a wire mesh or a gravel pack. The end of the piston 706 may be equipped with a seal pad 724. The passageway 712 communicates with a port 726, which communicates with one of the conduits 124*a*, 124*b*, 124*c*, 124*d* for receiving and carrying a formation fluid.

Figure 4B:
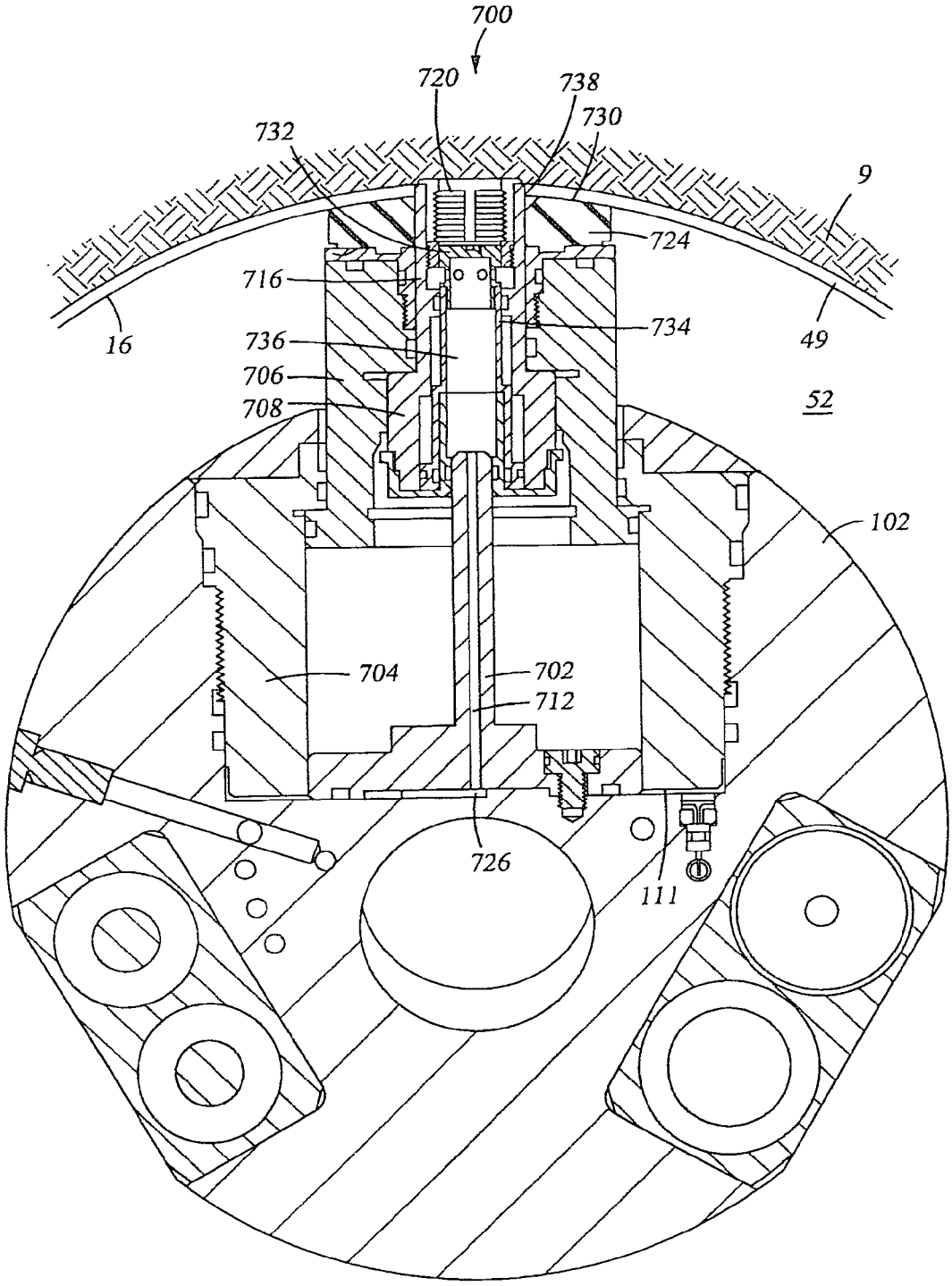
FIG. 4B is an alternative cross-section view of the probe of FIG. 4A in an extended position.

Referring now to FIG. 4B, the probe 700 is shown in an extended position. The piston 706 is actuated within the sleeve 704 from a first position shown in FIG. 4A to a second position shown in FIG. 4B, preferably by hydraulic pressure. The seal pad 724 is engaged with the borehole wall surface 16, which may include a mud or filter cake 49, to form a primary seal between the probe 700 and the borehole annulus 52. Then, the snorkel assembly 708 is actuated, by hydraulic pressure, for example, from a first position shown in FIG. 4A to a second position shown in FIG. 4B. The snorkel 716 extends through an aperture 738 in the seal pad 724 and beyond the seal pad 724. The snorkel 716 extends through the interface 730 and penetrates the formation 9. The probe 700 may be actuated to withdraw formation fluids from the formation 9, into a bore 736 of the snorkel assembly 708, into the passageway 712 of the stem 702 and into the port 726. The screen 720 filters contaminants from the fluid that enters the snorkel 716. The probe 700 may be equipped with a scraper 732 and reciprocating scraper tube 734 to move the scraper 732 along the screen 720 to clear the screen 720 of filtered contaminants.

The seal pad 724 is preferably made of an elastomeric material. The elastomeric seal pad 724 seals and prevents drilling fluid or other borehole contaminants from entering the probe 700 during formation testing. In addition to this primary seal, the seal pad 724 tends to deform and press against the snorkel 716 that is extended through the seal pad aperture 738 to create a secondary seal.

Figure 5:
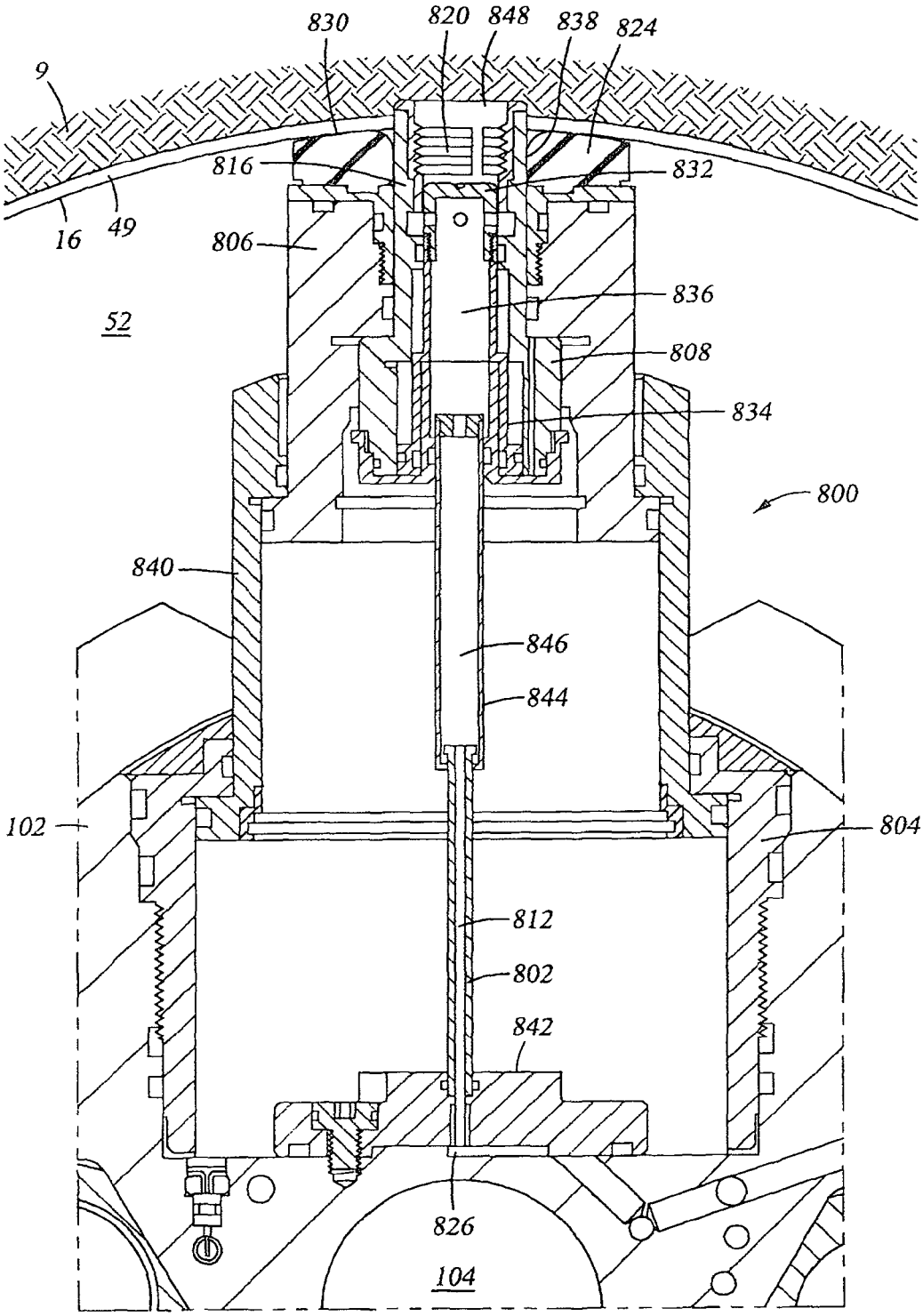
FIG. 5 is a cross-section view of another embodiment of the probe of FIG. 3, in an extended position.

Another embodiment of the probe is shown as probe 800 in FIG. 5. Many of the features and operations of the probe 800 are similar to the probe 700. For example, the probe 800 includes a sleeve 804, a piston 806 and a snorkel assembly 808 having a snorkel 816, a screen 820, a scraper 832 and a scraper tube 834. In addition, the probe 800 includes an intermediate piston 840 and a stem extension 844 having a passageway 846. The intermediate piston 840 is extendable similar to the piston 806 and the piston 706. However, the piston 840 adds to the overall distance that the probe 800 is able to extend to engage the borehole wall surface 16. Both of the pistons 806 and 840 may be extended to engage and seal a seal pad 824 with the borehole wall surface 16. The seal pad 824 may include elastomeric materials such that seals are provided at a seal pad interface 830 and at a seal pad aperture 838. The snorkel 816 extends beyond the seal pad 824 and the interface 830 such that a formation penetrating portion 848 of the snorkel 816 penetrates the formation 9. Formation fluids may then be drawn into the probe 800 through a screen 820, into a bore 836, into the passageway 846, into a passageway 812 of a stem 802 and a base 842, and finally into a port 826.

Figure 6:
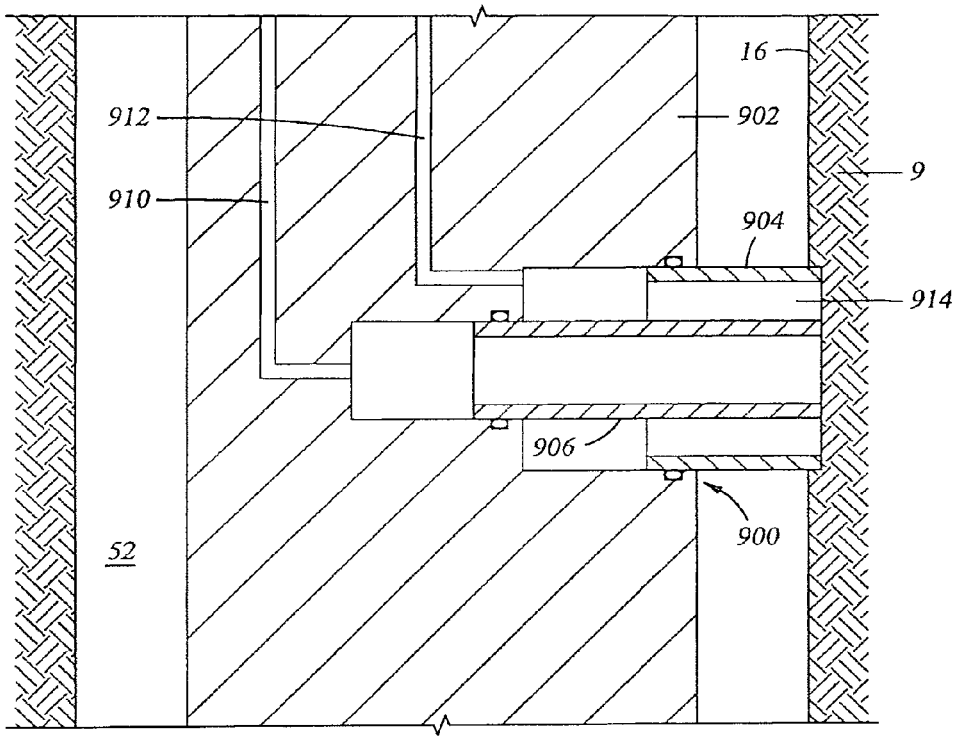
FIG. 6 is a cross-section view of yet another embodiment of the probe of FIG. 3, in an extended position.

Referring now to FIG. 6, yet another embodiment of a probe is shown as a probe 900. For simplicity of illustration, only a portion of a drill collar 902 is shown supporting the probe 900. Contact with the formation 9 is accomplished by extending an outer snorkel tube 904 and an inner snorkel tube 906. The tubes 904, 906 are independently movable, as one skilled in the art would understand and consistent with the teachings herein.

The inner snorkel tube 906 is connected to a probe flow line 910 while an annular region 914 between the inner snorkel tube 906 and the outer snorkel tube 904 defines a guard zone that is connected to a guard flow line 912. The flow lines 910, 912 each are provided with flow control devices (not shown) for drawing formation fluids in from the formation 9, such as pumps, draw down assemblies (such as draw down piston assembly 108), sample chambers, and other apparatus understood by one skilled in the art. The inner snorkel tube 906 defines a probe zone that is isolated by the outer snorkel tube 904 from the portion of the borehole outside the outer snorkel tube 904. The formation fluid draw down apparatus are operated long enough to substantially deplete the invaded zone in the vicinity of the outer snorkel tube 904 and to establish an equilibrium condition in which the fluid flowing into the inner snorkel tube 906 is substantially free of contaminating borehole filtrate. When the equilibrium condition is reached, contaminated fluid is drawn into the guard zone and uncontaminated fluid is drawn into the inner snorkel tube 906. At this time, sampling is started with the draw down apparatus continuing to operate for the duration of the sampling. As sampling proceeds, the borehole fluid continues to flow from the borehole towards the probe, while the contaminated fluid is preferentially drawn into the outer snorkel tube 804. Pumps (not shown) discharge the contaminated fluid into the borehole. The fluid from the inner snorkel tube 906 is retrieved to provide a sample of the formation fluid.

The inner snorkel tube 906 is surrounded by the outer snorkel tube 904. Because the flow line 910 of the inner snorkel tube 906 and the flow line 912 of the outer snorkel tube 904 are separate, the fluid flowing into the annular region 914 does not mix with the fluid flowing into the inner snorkel tube 906. The outer snorkel tube 904 isolates the flow into the inner snorkel tube 906 from the borehole annulus 52 beyond the outer snorkel tube 904. Thus three zones are defined in the borehole: a first zone including the inner snorkel tube 906 (a probe zone), a second zone including the annular region 914 (a guard zone), and a third zone including the borehole annulus 52 outside the outer snorkel tube 904 (a borehole zone). The probe zone is isolated from the borehole zone by the guard zone.

The flow lines 910, 912 each may be provided with pressure transducers (not shown). The pressure maintained in the flow line 912 is the same as, or slightly less than, the pressure in the flow line 910. With the configuration of the snorkel tubes 904, 906, borehole fluid that flows around the edges of the outer snorkel tube 904 is preferentially drawn into the guard zone and diverted from entry into the probe zone. The flow lines 910, 912 are provided with flow control devices, such as the draw down assembly 108 or a pump, which are operated long enough to substantially deplete the invaded zone in the vicinity of the probe 900 and to establish an equilibrium condition in which the fluid flowing into the inner snorkel tube 906 is substantially free of contaminating borehole filtrate. In this equilibrium condition, contaminated fluid is drawn into the guard zone. The fluid gathered in the guard zone can be pumped to a fluid sample chamber (not shown) or to the borehole, while the fluid in the probe zone is directed to a probe sample chamber (not shown).

Figure 7A:
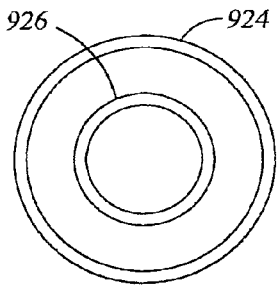
FIG. 7A is a front view of one embodiment of the probe of FIG. 6.
Figure 7B:
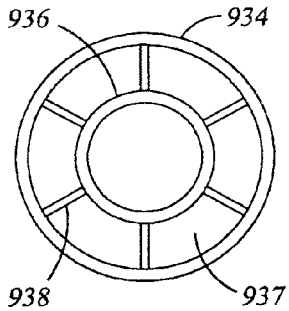
FIG. 7B is a front view of an alternative embodiment of the probe of FIG. 7A.
Figure 7C:
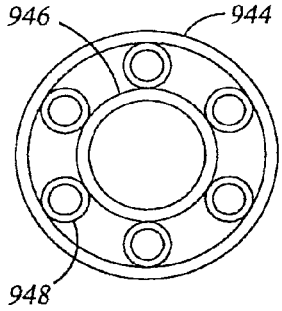
FIG. 7C is a front view of another alternative embodiment of the probe of FIG. 7A.

Referring now to FIGS. 7A-7C, alternative arrangements of the snorkel tubes 904, 906 are shown. In FIG. 7A, an inner snorkel tube 926 and an outer snorkel tube 934 are shown as concentric cylinders. In FIG. 7B, an annular region 937 (the guard zone) between an inner snorkel tube 936 and an outer snorkel tube 934 is segmented by a plurality of dividers 938. FIG. 7C shows an arrangement in which the guard zone is defined by a plurality of tubes 948 interposed between an inner snorkel tube 946 and an outer snorkel tube 944. In any of these configurations, a wire mesh or a gravel pack may also be used to avoid damage to the formation.

Although the embodiments of the drill collar section 100 described above include various embodiments of a probe, the drill collar section 100 alternatively includes other embodiments of an MWD tool. For example, the MWD tool in the drill collar section 100 may include a density pad that is hydraulically extendable, an MWD coring tool with a hydraulically extendable member, a reamer having hydraulically extendable arms, or other hydraulically actuated or powered tools. Common to these embodiments of the MWD tool is a hydraulically extendable members for various types of interaction with the earth formation 9. The MWD tool coupled to drill collar section 100 may include various other MWD devices and sensors. Preferably, such an MWD tool receives fluids and electrical signals or power for operation, as will be described more fully below.

Figure 8:
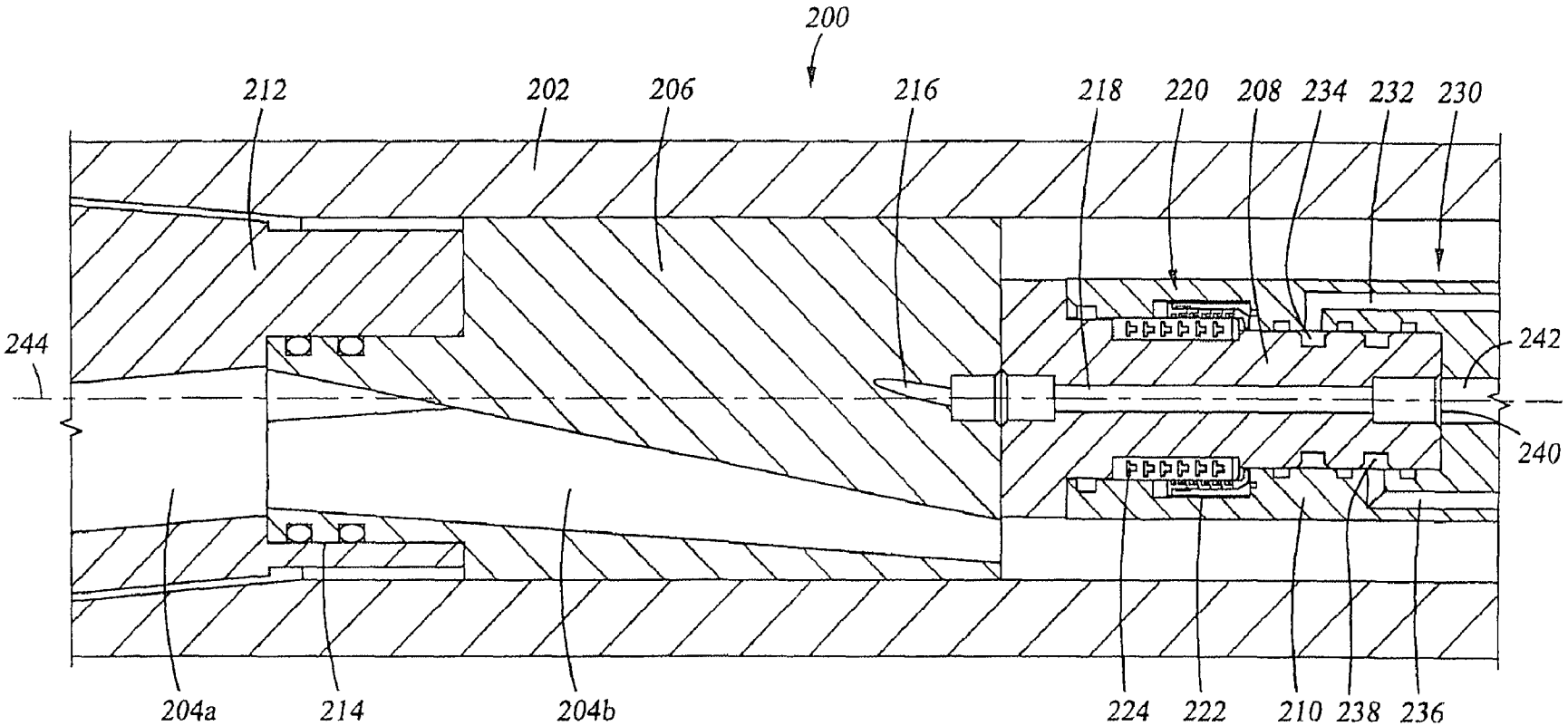
FIG. 8 is an enlarged, cross-section view of one embodiment of the interconnect assembly of FIG. 2.

Referring now to FIG. 8, an embodiment of the interconnect assembly 200 is shown in more detail. A drill collar 202 couples to the drill collar 102 of the drill collar section 100 of FIG. 3. The interconnect assembly 200 further includes a manifold 206, a manifold extension or connector 208, a manifold receiving portion or connector 210 and a flow bore housing 212. The flow bore housing 212 is connected to the manifold 206, and a flow bore 204*a* of the flow bore housing 212 communicates with a flow bore 204*b* in the manifold 206. In one embodiment, the flow bore housing 212 may be disconnected from the manifold 206 at the connection 214. The flow bore 204*b* connects to a flow bore (not shown) adjacent the manifold extension 208 and manifold receiving portion 210.

The manifold 206 further includes a flow port 216 connected to a flow line 218 in the manifold extension 208. The manifold extension 208 includes a first electrical connector housing 224 having one or more electrical connectors. The manifold receiving portion 210, which receives and couples to the manifold extension 208, includes a second electrical connector housing 222 having one or more electrical connectors that couple to and communicate with the electrical connector or connectors of the first electrical connector housing 224. In this configuration, as shown in FIG. 8, the electrical connector housings 222, 224 provide an electrical connection 220 wherein one or more electrical conduits or lines (not shown) in the receiving portion 210 communicate with one or more electrical conduits or lines (not shown) in the manifold 206. The electrical conduits may carry electrical data signals or power, for example.

The manifold extension 208 further includes a first port 234 communicating with a first fluid flow line 232 in the receiving portion 210, and a second port 238 communicating with a second fluid flow line 236 in the receiving portion 210. The manifold extension fluid flow line 218 couples to a receiving portion fluid flow line 242 at connection 240. In this configuration, as shown in FIG. 8, the fluid flow lines and ports just described combine to provide a fluid line connection 230. The ports 234, 238 connect to fluid conduits or lines (not shown) in the manifold 206. The fluid flow lines 232, 236, 242 connect to fluid conduits or lines (not shown) in the hydraulic assembly 140 of the drill collar section 100. In one embodiment, the fluid flow line 232 carries hydraulic system fluid, the fluid flow line 236 carries a hydraulic reservoir fluid (such as the hydraulic reservoir described elsewhere herein) and the fluid flow line 242 (and the fluid line 218) carries a formation fluid.

In one embodiment, the electrical connection 220 and the fluid line connection 230 extend radially about the manifold extension 208 a full 360 degrees. For example, the electrical connector housings 222, 224 are concentric cylinders such that they extend completely around the manifold extension 208. The ports 234, 238 may extend completely around the manifold extension 208 also. Thus, in any radial position of the manifold extension 208 about a longitudinal axis 244, the electrical connector housings 222, 224 will be in contact and communicating, and the ports 234, 238 will be communicating with the fluid flow lines 232, 236, respectively. One or both of the manifold extension 208 and the receiving portion 210 may rotate relative to the other, and the electrical connection 220 and the fluid line connection 230 will not be disturbed. The rotatable nature of the connections 220, 230 and the relationship between the manifold extension 208 and the receiving portion 210 provide a rotatable interconnect assembly 200.

In one embodiment, the interconnect assembly is disconnectable. The manifold 206 and manifold extension 208 are removable from the receiving portion 210. The manifold 206 and manifold extension 208 are axially displaced and the receiving portion 210 releases the manifold extension 208. Thus, any drill collar sections or tools coupled above and below the interconnect assembly 200 are removable from one another.

Figure 9A:
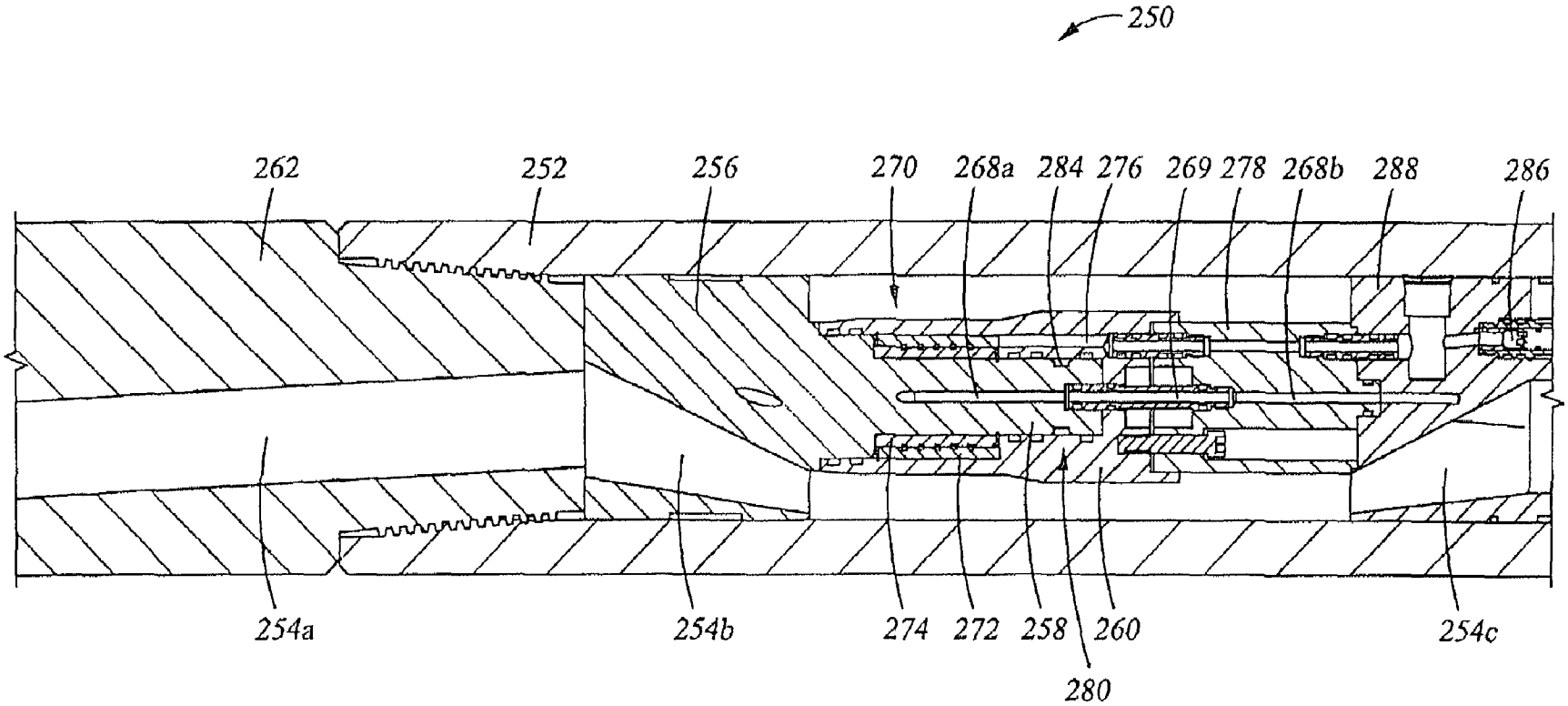
FIG. 9A is an enlarged, cross-section view of another embodiment of the interconnect assembly of FIG. 8, in a connected or closed position.
Figure 9B:
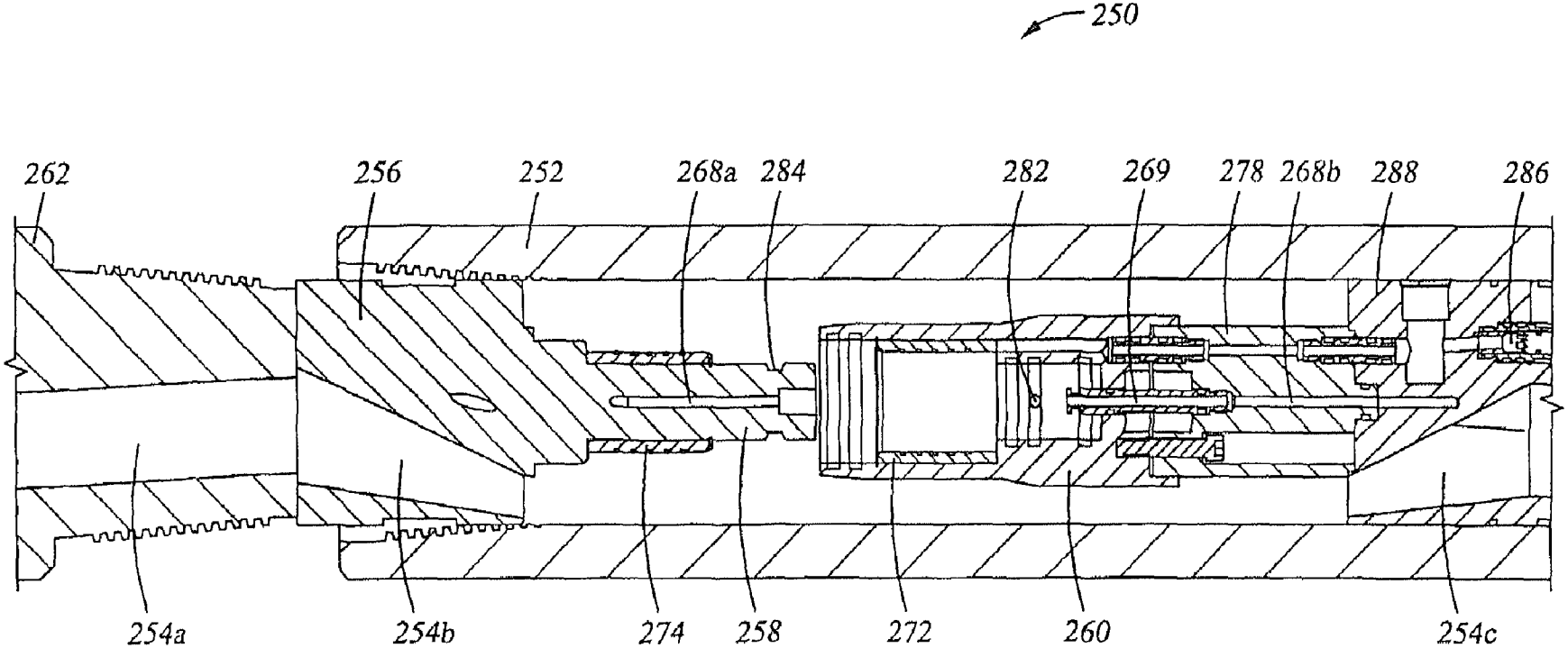
FIG. 9B is an enlarged, cross-section view of the embodiment of the interconnect assembly of FIG. 9A, in a disconnected or open position.

In another embodiment, and referring to FIGS. 9A and 9B, the interconnect assembly is shown as interconnect assembly 250. A housing 262 having flow bore 254*a* is connected to a manifold 256 having flow bore 254*b* communicating with flow bore 254*a*. The manifold 256 is similar to the manifold 206 of FIG. 8, with the manifold 256 including a manifold extension or connector 258. The manifold extension 258 includes electrical connector housings 272, 274 providing the electrical connection 270. A fluid line connection 280 includes ports, such as a port 284 and a port 282 seen in FIG. 9B, that allow hydraulic fluid lines or conduits (not shown) in the manifold extension 258 to communicate with hydraulic fluid lines (not shown) in a manifold receiving portion or connector 260. The manifold receiving portion 260 includes an electrical conduit 276 communicating with the one or more electrical connectors in the electrical connection 270. The electrical conduit 276 extends through a manifold 278 and manifold 288, and may carry electrical signals or power, as previously described with respect to the interconnect assembly 200. The manifold extension 258 includes a fluid flow line 268*a* connected to a fluid line connector 269, which is connected to a fluid flow line 268*b* extending through the manifolds 278, 288. Fluid flow line 268*a*, 268*b* and connector 269 may carry, for example, a formation fluid. The manifold 280 further includes a flow bore 254*c* and an electrical connector 286. In some embodiments, the manifold 278 is removed to shorten the axial length of the interconnect assembly, thereby adapting the adjacent drill collars or the tool for length cutbacks.

Referring now to FIG. 9B, the interconnect assembly 250 is shown in a disconnected position. The housing 262 and the manifold 256 are displaced axially and the manifold extension connector 258 is removed from the receiving portion 260. The electrical connector housing 272 is disengaged from the electrical connector housing 274, and the fluid ports, such as the ports at 268*a* and 284, are disengaged from other fluid ports, such as the ports at 269 and 282, respectively. The housing 262 and the manifold 256 may slide completely out of the drill collar 252.

The electrical connection 270 and fluid line connection 280 allow the manifold 256 and manifold extension 258 to rotate relative to the receiving portion 260, similar to the components of the interconnect assembly 200. Thus, like the interconnect assembly 200, the interconnect assembly 250 embodiment is a rotatable connector having electrical, power and fluid pass-through capabilities when connected, and allows for tools above and below the interconnect assembly to be removable from one another. For example, the drill collars above and below the interconnect assembly can be unscrewed from each other, because the interconnect assembly is rotatable, or rotary, and another drill collar, having a fluid ID tool, for example, can be screwed into the interconnect assembly.

Figure 10:
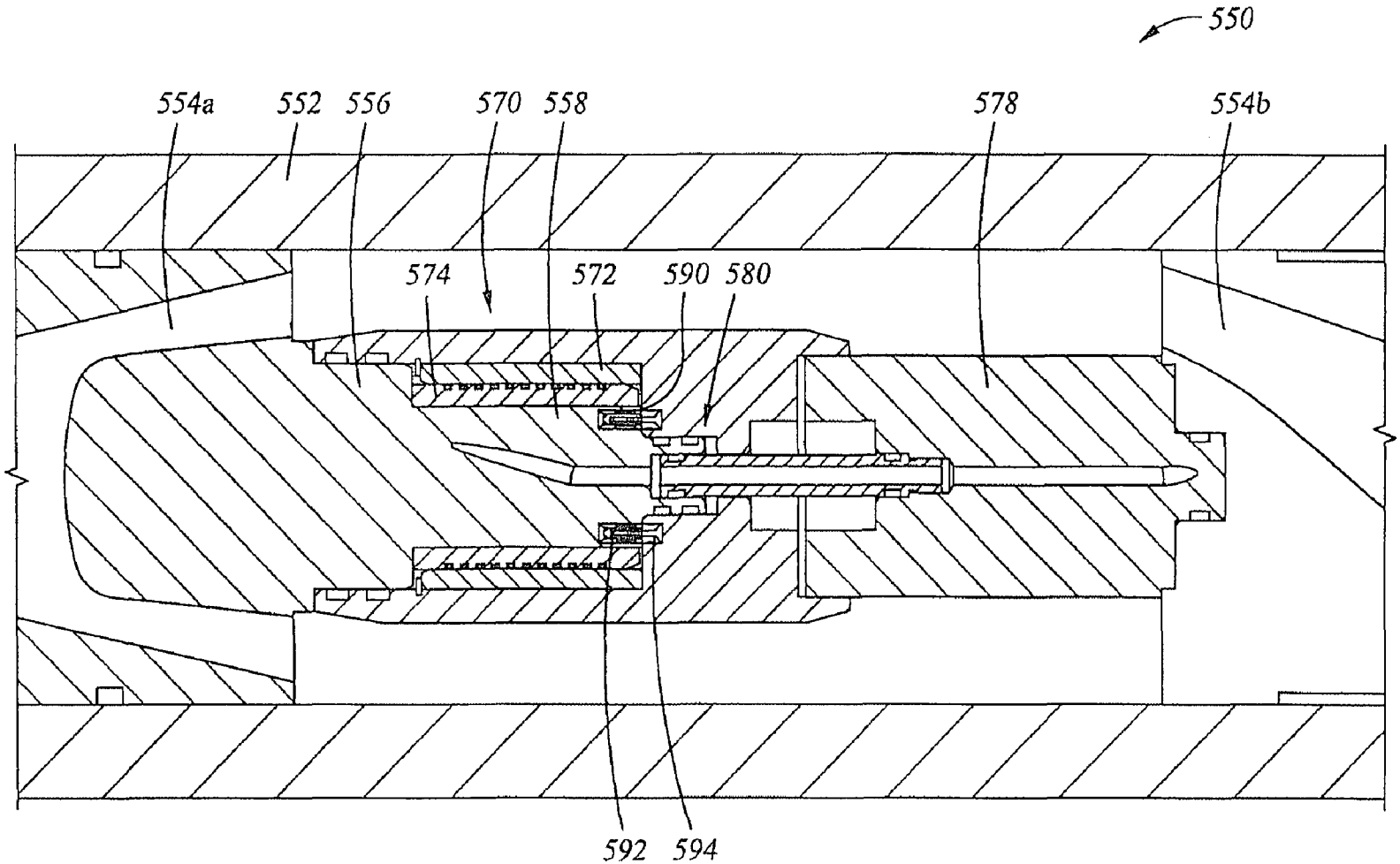
FIG. 10 is an enlarged, cross-section view of another embodiment of the interconnect assembly of FIG. 8, in a connected or closed position.

Referring next to FIG. 10, another embodiment of the interconnect assembly is represented as interconnect assembly 550. A manifold 556 having manifold extension 558 connects to a manifold 578, similar to previously described embodiments of the interconnect assemblies. An electrical connection 570 includes electrical connector housings 572, 574. The manifold extension 558 connects to the manifold 578 at a fluid connection 580. However, unlike previous embodiments of the interconnect assembly, the interconnect assembly 550 includes a manifold extension 558 having a shoulder 590. The shoulder 590 may be equipped with an electrical contact 592 that engages an electrical contact 594. Thus, electrical conduits or lines (not shown) that connect to the electrical contacts 592, 594 are located at a different radial position, i.e., a different diameter, than the electrical lines coupled to the electrical connector housings 572, 574. This prevents the different electrical lines form interfering with each other in the limited space of the interconnect assembly and drill collar embodiments described herein. Furthermore, a flow bore 554*a* and a flow bore 554*b* are deviated and angled to direct the drilling fluids around the centrally located interconnect manifolds and connections. In some embodiments, the connector housings 572, 574 form a five-contact radial connector and the contacts 592, 594 form a single contact, face to face connector. In further embodiments, the fluid connection 580 includes only a flow line for mud or other sampled fluids, and does not include hydraulic lines.

In several of the interconnect assembly embodiments, the central flow line, such as flow lines 218, 268, is centrally located and does not include path changes to simplify the interconnect assembly and improve its functionality. The several embodiments of the interconnect assembly provide rotary or rotatable connections, fluid and electrical, such that a first tool housing may be screwed together with a second tool housing. In some embodiments, the tool housings are drill collars that are compatible with each other such that the tool housings are interchangeable with other tool housings having different tools or portions of an MWD system. Some tools may have different requirements than others, but the several embodiments of the interconnect assembly provide different combinations of fluid and electrical connections such that the communication needs of a variety of different tools are met. Thus, the interconnect assembly increases the interchangeability and connectability of the multiple drill collars that make up a downhole MWD tool.

Figure 11:
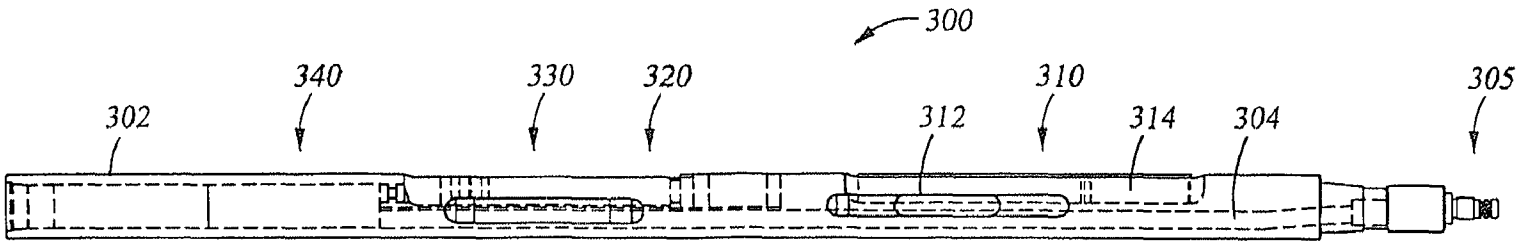
FIG. 11 is a partial schematic and partial cross-section view of one embodiment of a power drill collar section of the MWD tool of FIG. 2.

Referring now to FIG. 11, an embodiment of the power drill collar section 300 is shown in more detail. The power collar 300 includes a drill collar 302, a flush pump assembly 310 having a flush pump 312 and external reservoir 314, a flow gear or turbine assembly 320, an electronics module 330 and a drilling fluid flow bore diverter 340. At one end of the power collar 300 is a connector 305 for connection to corresponding components of an interconnect assembly consistent with the embodiments disclosed herein. For example, the connector 305 may correspond with the housing 212, manifold 206 and manifold extension 208 of FIG. 8, or the housing 262, manifold 256 and manifold extension 258 of FIG. 9A. The connector 305 allows the power collar 300 to be removable from the probe collar 100, for example, or other MWD tool to which the power collar 300 may be connected. The connector 305 couples to an interconnect assembly, such as embodiments 200, 250, and allows electrical signals, power and fluids to pass through connections therein to a drill collar section or MWD tool below.

Figure 12A:
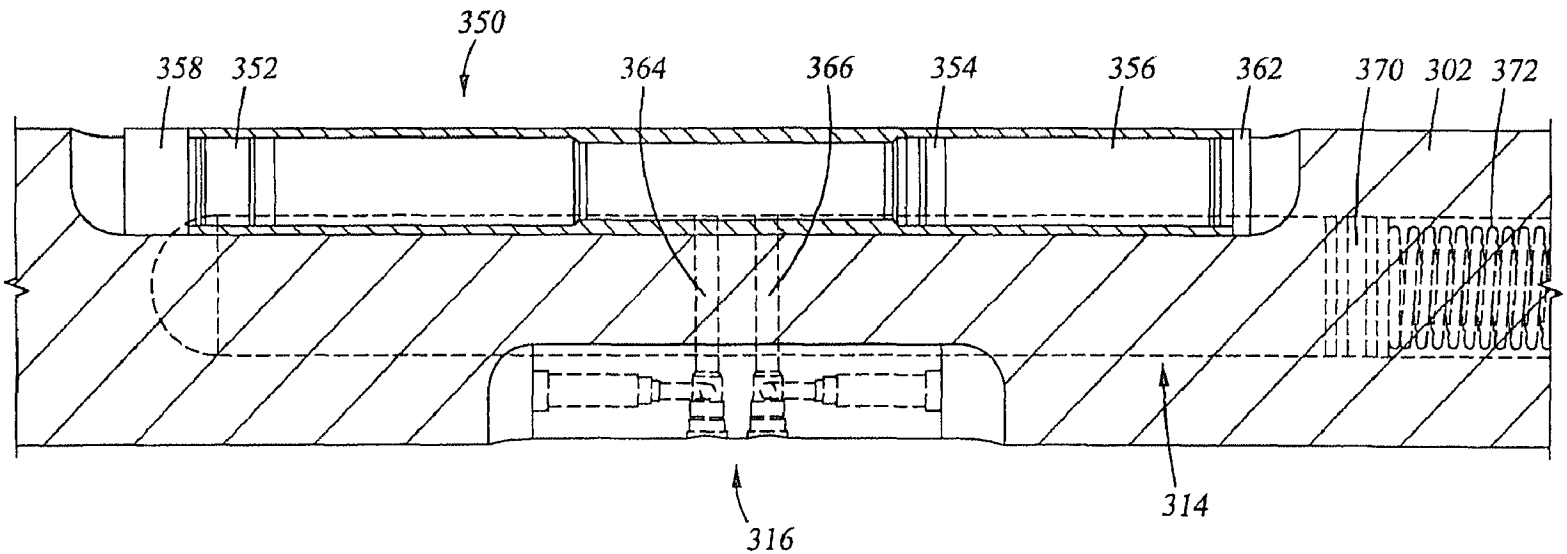
FIG. 12A is a partial schematic and partial cross-section view of one embodiment of a flush pump assembly of the MWD tool of FIG. 2.

Referring now to FIG. 12A, an embodiment of the flush pump assembly 310 is shown in more detail. The flush pump 312 includes a piston 350 having a first end 352 and a second end 354, the piston 350 being reciprocally disposed in a cylinder 356 having a first end 358 and a second end 362. The ends 358, 362 may be equipped with sensors. The flush pump 312 may, for example, be a dual action pump to provide a fluid flow in both of a flow line 364 and a flow line 366, and through other fluid lines in a fluid line manifold and control valve assembly 316.

The external reservoir 314 includes a cylinder 368, a piston 370 and a spring 372. The external reservoir 314 may communicate with the tool's hydraulic system and with the borehole annulus to provide a stabilizing pressure to the tool's hydraulic system.

Figure 12B:
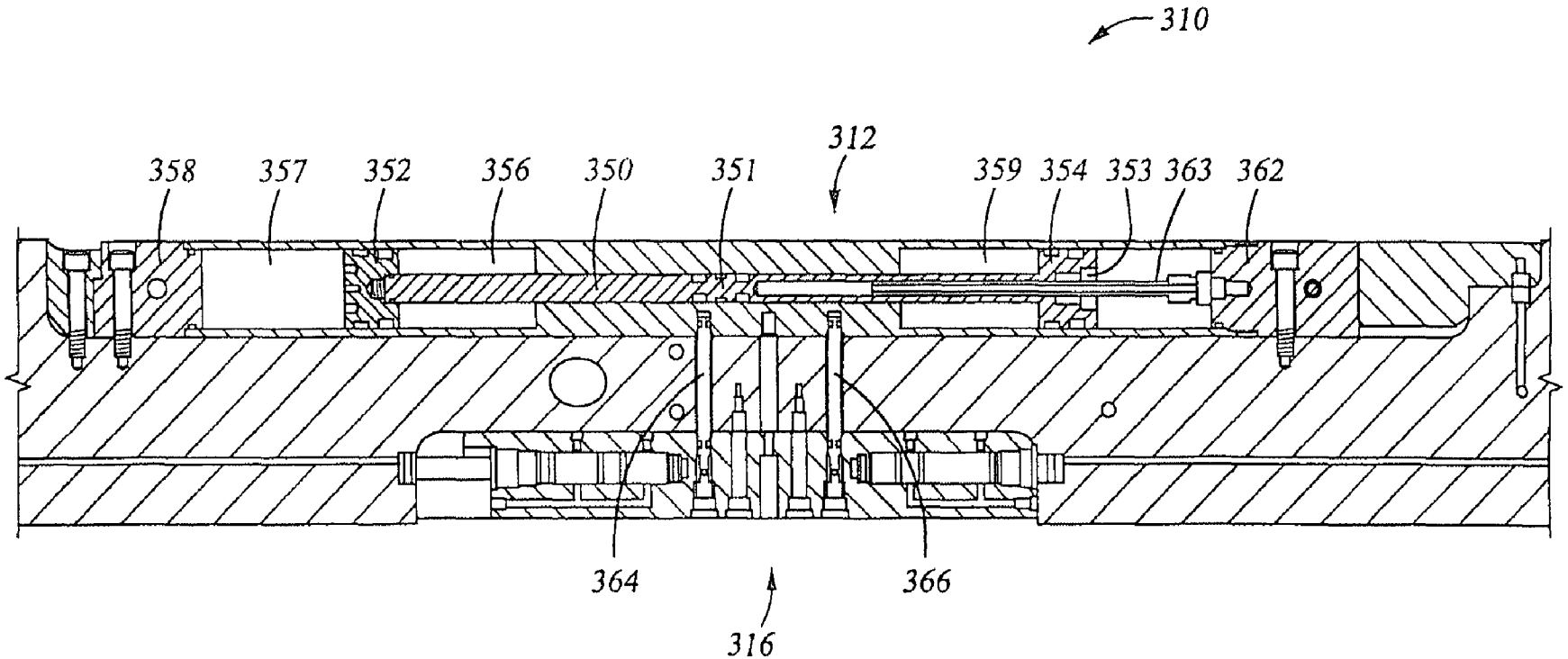
FIG. 12B is a different cross-section view of the flush pump assembly of FIG. 12A.

Referring next to FIG. 12B, a different cross-section view of the flush pump assembly 310 is shown. The piston 350 is reciprocal in the cylinder 356 between the ends 358, 362. The end 362 includes a hydraulic fluid extension 363 inserted into a receptacle 353 in the piston end 354. Hydraulic fluid may be flowed into and out of the piston extension 363 to adjust hydraulic fluid pressure in the receptacle 353. The adjustable hydraulic fluid pressure causes the piston 350 to reciprocate, in turn causing the piston end 352 to reciprocate in a chamber 357 and the piston end 354 to reciprocate in a chamber 359. The dual pistons ends 352, 354 in the dual chambers 357, 359 provide a dual action pump 312, wherein multiple fluid flow paths may be established in the fluid flow lines 364, 366 and other fluid flow lines shown as part of the fluid manifold and control valve assembly 316. Check valves in the assembly 316 control the direction of the fluid flows in the various flow lines. The present disclosure is not limited to the pump embodiment of FIGS. 12A and 12B, as other pumps and dual action pumps may be used in the flush pump assembly 310.

Figures 13, 20:
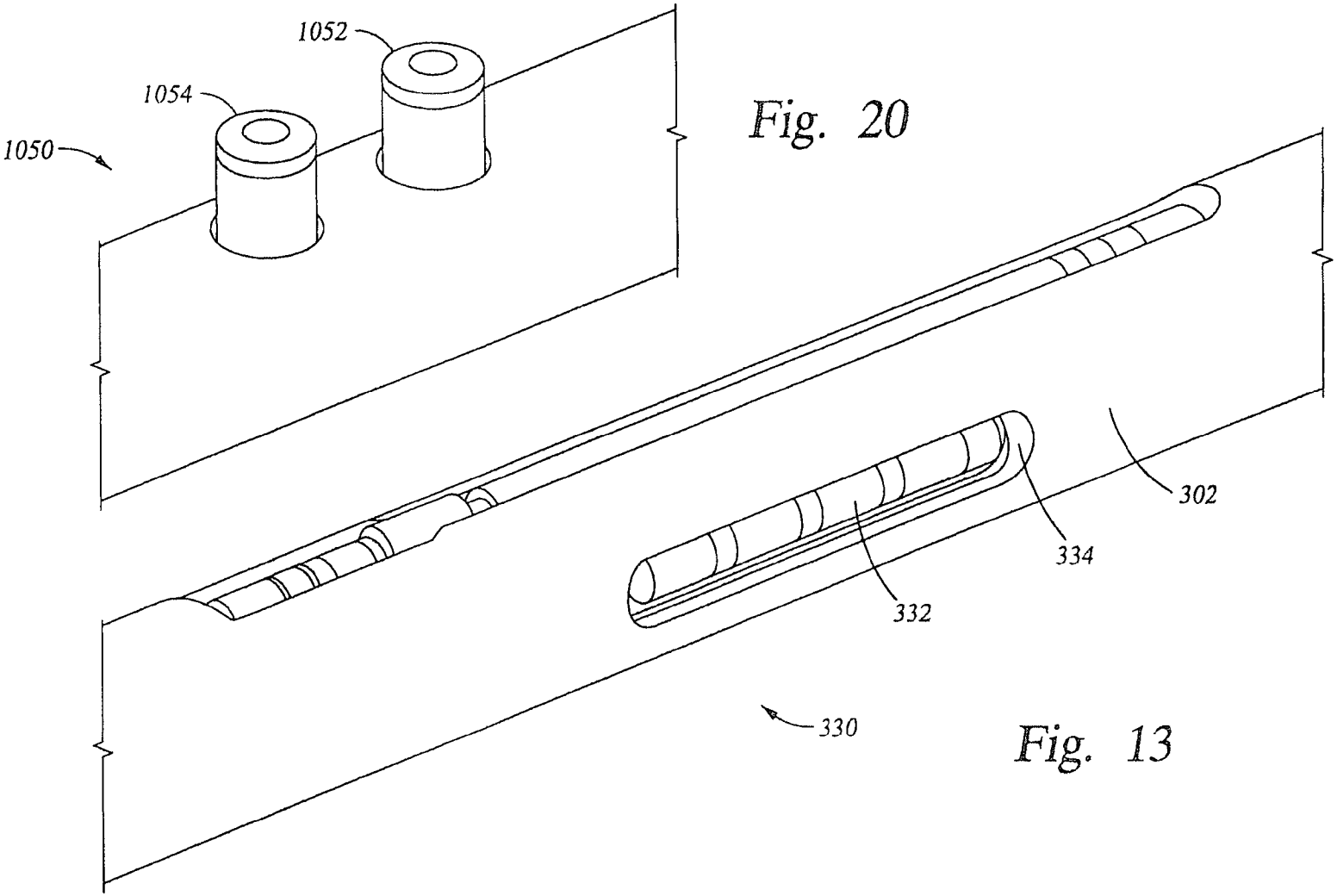
FIG. 13 is a partial schematic and perspective view of one embodiment of an electronics module of the MWD tool of FIG. 2.
FIG. 20 is a perspective view of another embodiment of a portion of the probe drill collar section of FIG. 3.

Referring now to FIG. 13, an embodiment of the electronics module 330 is shown in more detail. The module 330 includes an outsert 332 mounted in a pocket 334 in the drill collar 302. The outsert 332 is adapted to be removable from the exterior of the drill collar, and the pocket 334 can easily receive other outserts, making the outserts easily interchangeable. The electronics in the module 330 are adapted to control various components and operations of the tool, receive information from the tool, and operate in other ways as is understood by one skilled in the art.

Figure 14:
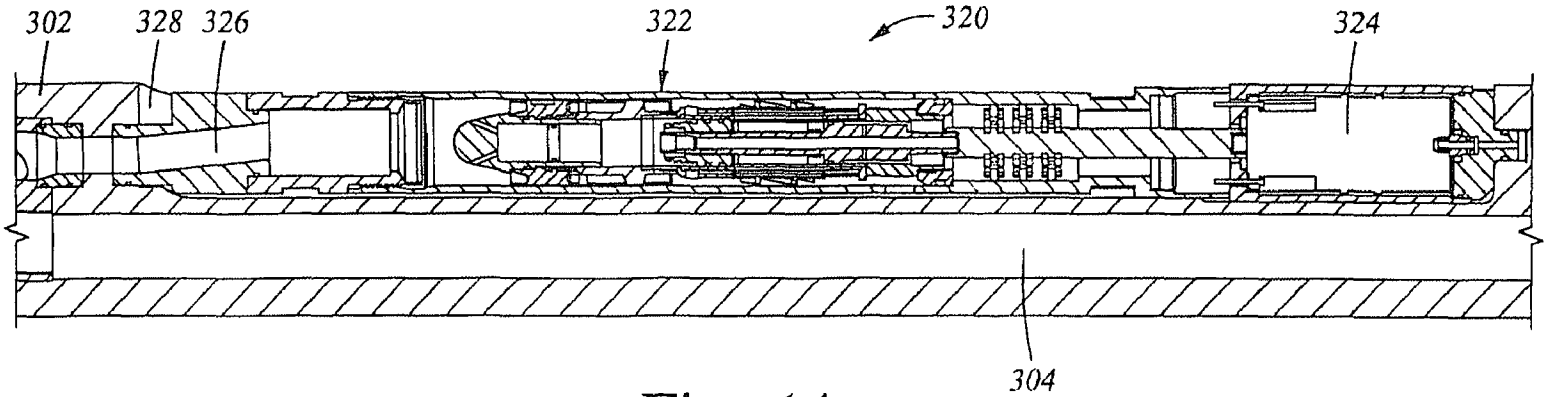
FIG. 14 is a partial schematic and partial cross-section view of one embodiment of a flow gear assembly of the MWD tool of FIG. 2.

Referring next to FIG. 14, an embodiment of the flow gear or turbine assembly 320 is shown in more detail. The assembly 320 includes flow gear 322 coupled to a hydraulic pump 324. A diversion flow bore 326 communicates fluid to the flow gear 322. The flow gear 322, the hydraulic pump 324 and the flow bore 326 may be offset from the primary flow bore 304, such as in a pocket 328.

Figure 15:
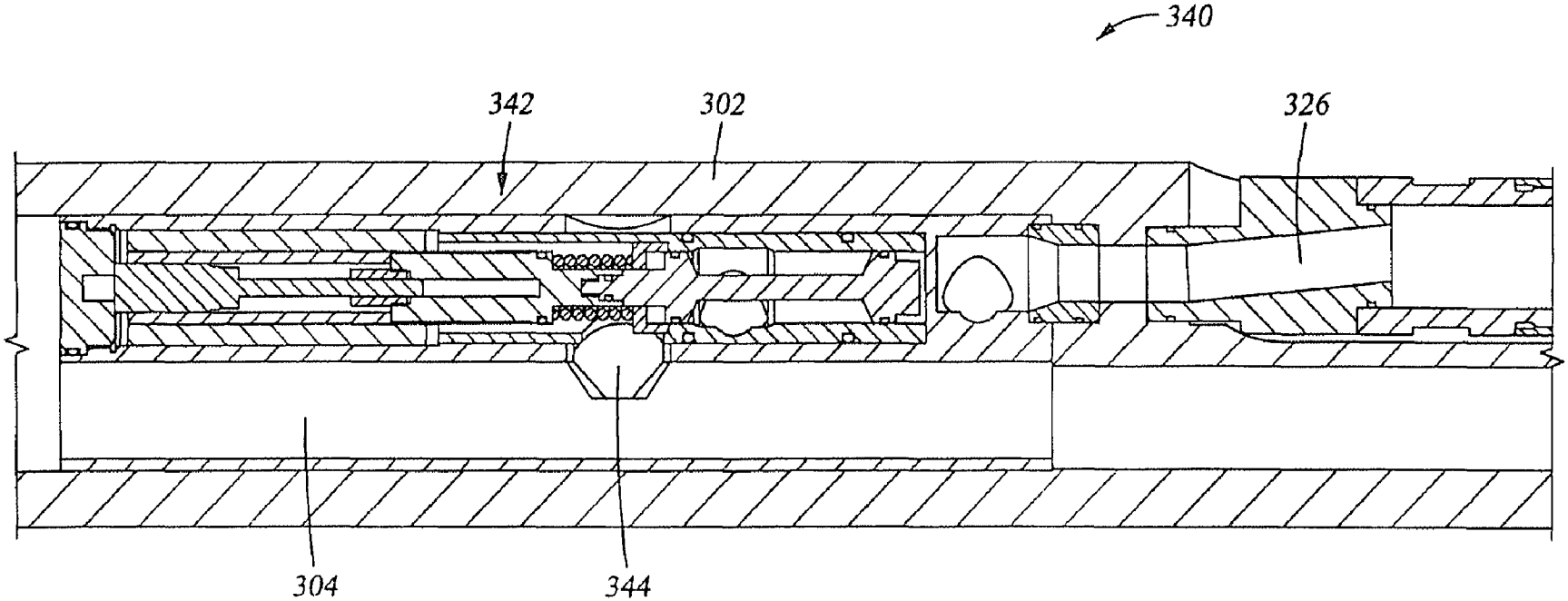
FIG. 15 is a partial schematic and partial cross-section view of one embodiment of a flow bore diverter of the MWD tool of FIG. 2.

Referring now to FIG. 15, an embodiment of the drilling fluid flow bore diverter 340 is shown in more detail. The diverter 340 includes a valve assembly 342 and a flow port 344. When valve assembly 342 is opened, drilling fluid from the primary flow bore 304 is diverted through the flow port 344, through the valve assembly 342, and into the diversion flow bore 326. As previously described, the flow bore 326 communicates with the flow gear 322, thereby providing the diverted drilling fluid to the flow gear 322. The diverted drilling fluid causes the flow gear 322 to turn, thereby operating the hydraulic pump 324. The hydraulic pump 324 provides hydraulic power to other portions of the tool. Thus, selective actuation of the valve assembly 342 selectively provides the drilling fluid that drives the power generating flow gear 322 and hydraulic pump 324. Further, the valve assembly 342 may be adjusted to allow varying amounts of drilling fluid flow through the valve assembly 342, thereby providing variable power generation from the flow gear 322 and the hydraulic pump 324.

Figure 16A:
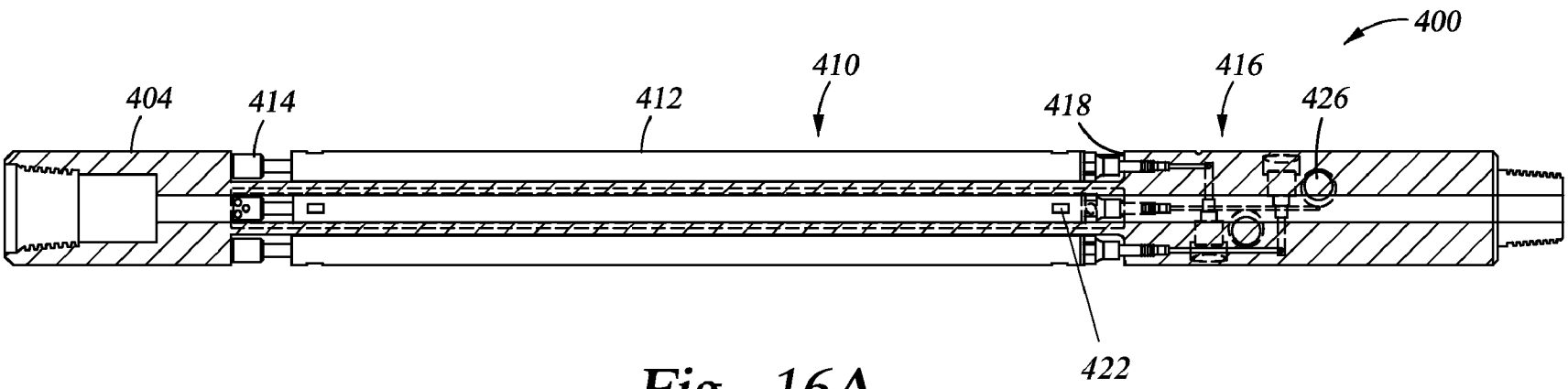
FIG. 16A is a partial schematic and partial cross-section view of one embodiment of a sample bottle drill collar section of the MWD tool of FIG. 2.
Figure 16B:
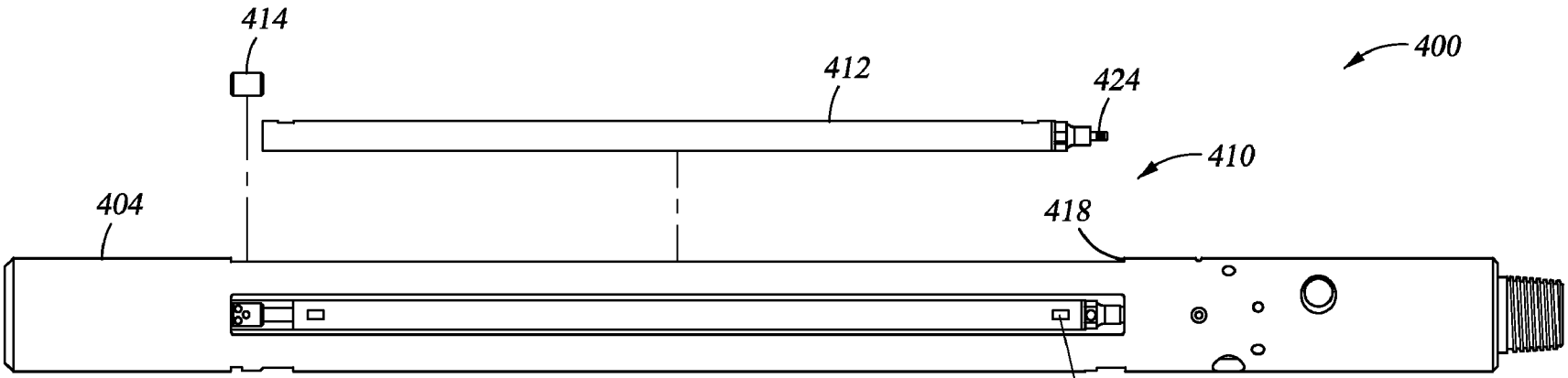
FIG. 16B is a side view of the sample bottle drill collar section of FIG. 16A.

Referring now to FIGS. 16A and 16B, an embodiment of the sample bottle drill collar section 400 is shown in more detail. The sample bottle collar section 400 includes a drill collar 404 housing a sample bottle assembly 410. The assembly 410 includes one or more removable sample bottles 412. The sample bottle 412 is secured to the drill collar 404 in a pocket 418 by one or more locking nuts 414, which may be bolted to the drill collar 404. The sample bottle 412 is removably coupled to the drill collar 404 and a fluid manifold and control assembly 416 via a connector 424. The pocket 418, the removable nut 414 and the connector 424, as shown in FIG. 16B, allow the sample bottle 412 to be removed at the rig or drill site. When connected into the sample bottle assembly 410, as shown in FIG. 16A, the bottle 412 communicates with the fluid manifold and control assembly 416 to receive sampled fluids. One or more sample shut-in valves 426 control the fluid flow into the sample bottle 412. As shown in FIG. 2, a second sample bottle assembly 420 may be coupled in series, or stacked, with the sample bottle assembly 410.

In one embodiment, the sample bottle assembly 410 includes a sample bottle identification system. In one embodiment, the sample bottle 412 is equipped with an electronic chip, such as at 422. The electronic chip 422 may be programmable to receive and store information identifying the contents of the sample bottle 412, or otherwise identifying the sample bottle 412. While the chip 422 receives information or is programmable while installed in the assembly 410, in one embodiment, the chip 422 remains secured to the bottle 412 when it is removed. Then, at a different location, the chip 422 may be accessed to identify the bottle 412 or its contents. Each sample identification chip, or SID, has a unique signature. Thus, each sample bottle is electronically and uniquely identifiable. Further, in some embodiments, each SID may store temperature of the sample fluid, time of sampling, depth of sampling, the transaction executed and other information.

Figure 17:
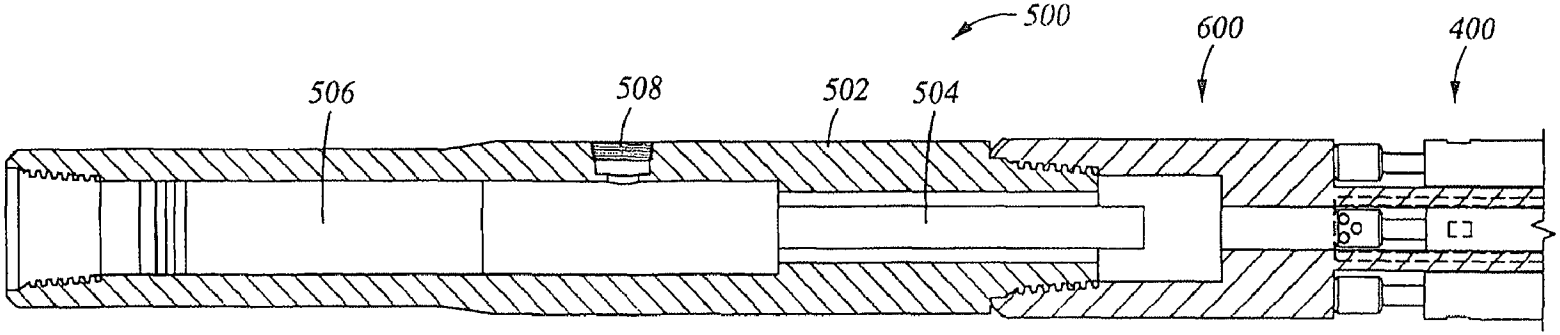
FIG. 17 is a partial schematic and partial cross-section view of one embodiment of a terminator drill collar section of the MWD tool of FIG. 2.

Referring now to FIG. 17, an embodiment of the terminator collar section 500 is shown in more detail. The terminator collar 500 includes a drill collar 502, a flow bore 504, a batteries and electronics module 506, and a fluid exit port 508.

The fluid exit port 508 is a flow line where fluid from a flush pump, such as flush pump 312, exits the tool and enters the annulus surrounding the tool. The terminator collar 500 also includes another embodiment of an interconnect assembly, the interconnect assembly 600. The interconnect assembly 600 is consistent with the teachings herein of the other interconnect assemblies, such that the interconnect assembly 600 provides electrical, power and fluid pass-through capabilities from the terminator collar assembly 500 to the sample bottle collar 400, as shown in FIG. 17. In one embodiment, the interconnect assembly 600 removably connects the terminator collar assembly 500 with the top of the sample bottle collar 400. In another embodiment, the interconnect assembly 600 removably connects the terminator collar assembly 500 with the top of the power collar 300. Other arrangements of the components taught herein are possible as various configurations of these components are contemplated by the present disclosure.

Figure 18:
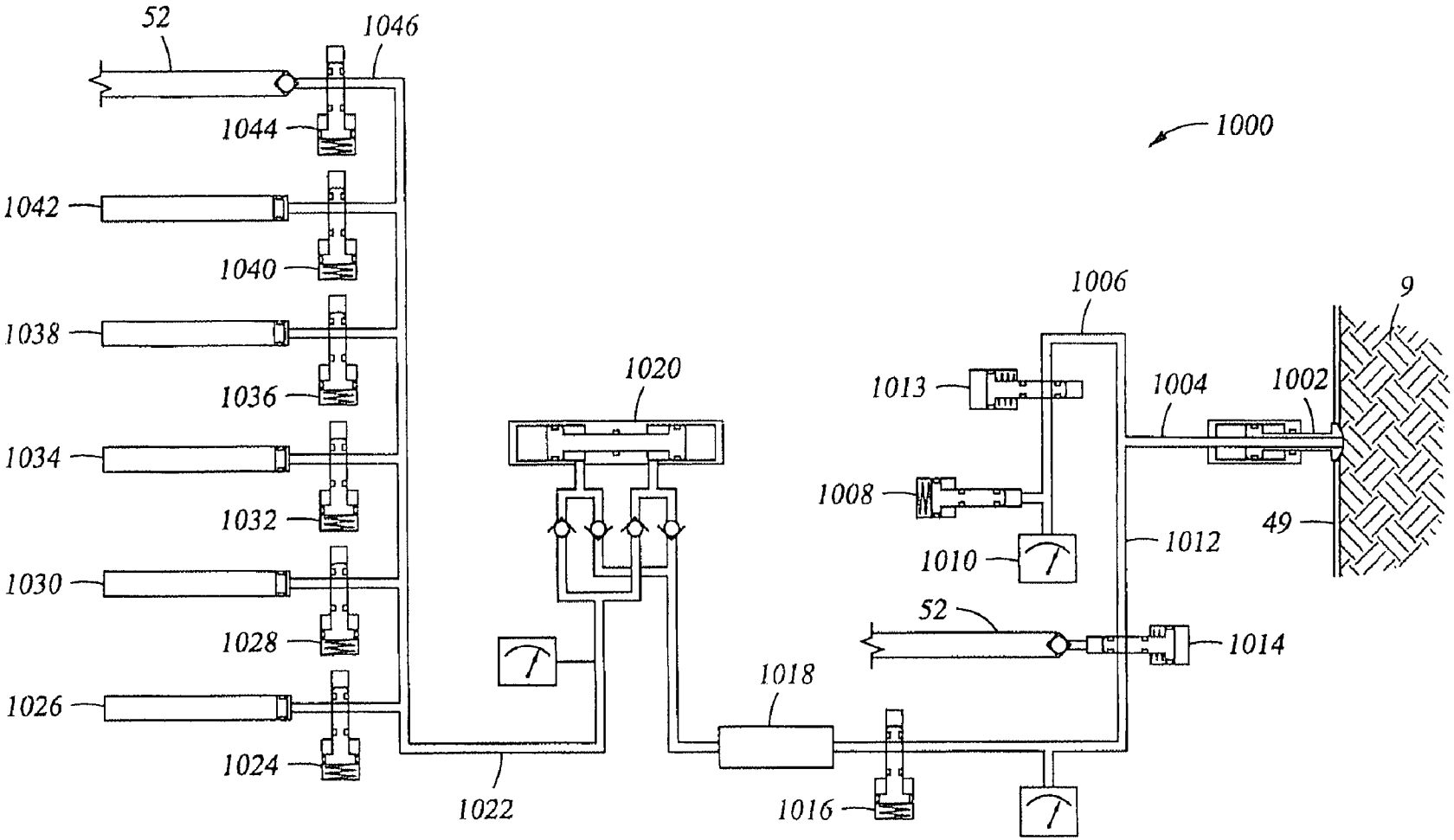
FIG. 18 is schematic view of one embodiment of a sampling and flow line assembly.

Referring now to FIG. 18, one embodiment of the tool 10 is shown schematically. In this embodiment, a complete sample probe to sample chamber system is shown connected by a flow line, and including components consistent with the various embodiments described herein. The system 1000 includes, for example, a sample probe 1002 and a draw down assembly 1008 consistent with similar embodiments of each as disclosed herein. The draw down assembly 1008 may be actuated to draw a limited amount of formation fluids in through the probe 1002 and into the flow lines 1004 and 1006. Flow line 1006 includes a shut-in valve 1013 just upstream of the draw down assembly 1008. Typically, a flow line shut-in valve 1016 is closed during this time. An equalizer valve 1014 may be used for draw down purposes also, to vent to the annulus 52 and equalize pressure in the system. However, the flow line shut-in valve 1016 may be opened to expose the probe 1002 to a flush pump 1020, sampling chambers 1026, 1030, 1034, 1038, 1042 and a vent or exit port 1044 to the annulus 52. The flush pump, sampling chambers and exit port are consistent with embodiments of the flush pump, sample bottles and exit port described herein.

The flush pump 1020 may be actuated to continuously draw formation fluids into the probe 1002. In one embodiment, sample shut-in valves 1024, 1028, 1032, 1036, 1040 are closed and the fluids pumped through the flush pump 1020 are sent to the annulus 52 via the vent 1044. In this embodiment, the shut-in valve 1016 is open. The reciprocating nature of the flush pump 1020 encourages separation of the sample or formation fluids from the contamination fluids drawn in from around the probe, also called "skimming," such that a less contaminated sample is obtained. Examples of contaminants that are skimmed from the target fluid include gas, drilling fluid and water. The skimmed contaminants may then be flushed from the system through the flow lines 1022, 1046 and out through the vent 1044. Contaminants may be detected in the pump 1020 via the sensors in the ends of the pump, for example, or by observing a steady-state of the sampled fluids from other sensors throughout the tool's system. In another embodiment, when desired, the sample shut-in valves can be opened at various times to fill the sample chambers with formation fluids. In yet another embodiment, the sample bottles may then be identified as previously described.

In some embodiments, the flow line 1012 carries formation fluids, or other fluids introduced into the MWD tool, past a fluid ID sensor 1018. The fluid ID sensor includes one or more fluid ID sensors for directly measuring properties of the fluid in the flow line 1012. The fluid ID sensor 1018 monitors fluids pumped through the tool. Exemplary sample fluid ID sensors include a resistivity sensor, a conductivity sensor, a density sensor, a dialectric sensor and a toroidal conductivity dialectric sensor. As opposed to some sensors in the tool, such as the pressure sensor 1010, the fluid ID sensor 1018 directly measures sample fluid properties. As the fluid then passes through flow lines 1022, 1046, the fluid may be processed as previously described. Thus, system 1000 is one embodiment of a fluid ID tool that may be used in conjunction with various combinations of the embodiments disclosed herein. The flow rate, volume, and other characteristics of the fluid in the flow line 1012 may be controlled by the various flow control devices of the system 1000, such as the valves 1014, 1016 and the pump 1020, such that certain properties of the fluid may be determined by the fluid ID sensor 1018 and other devices disclosed herein.

Figure 19:
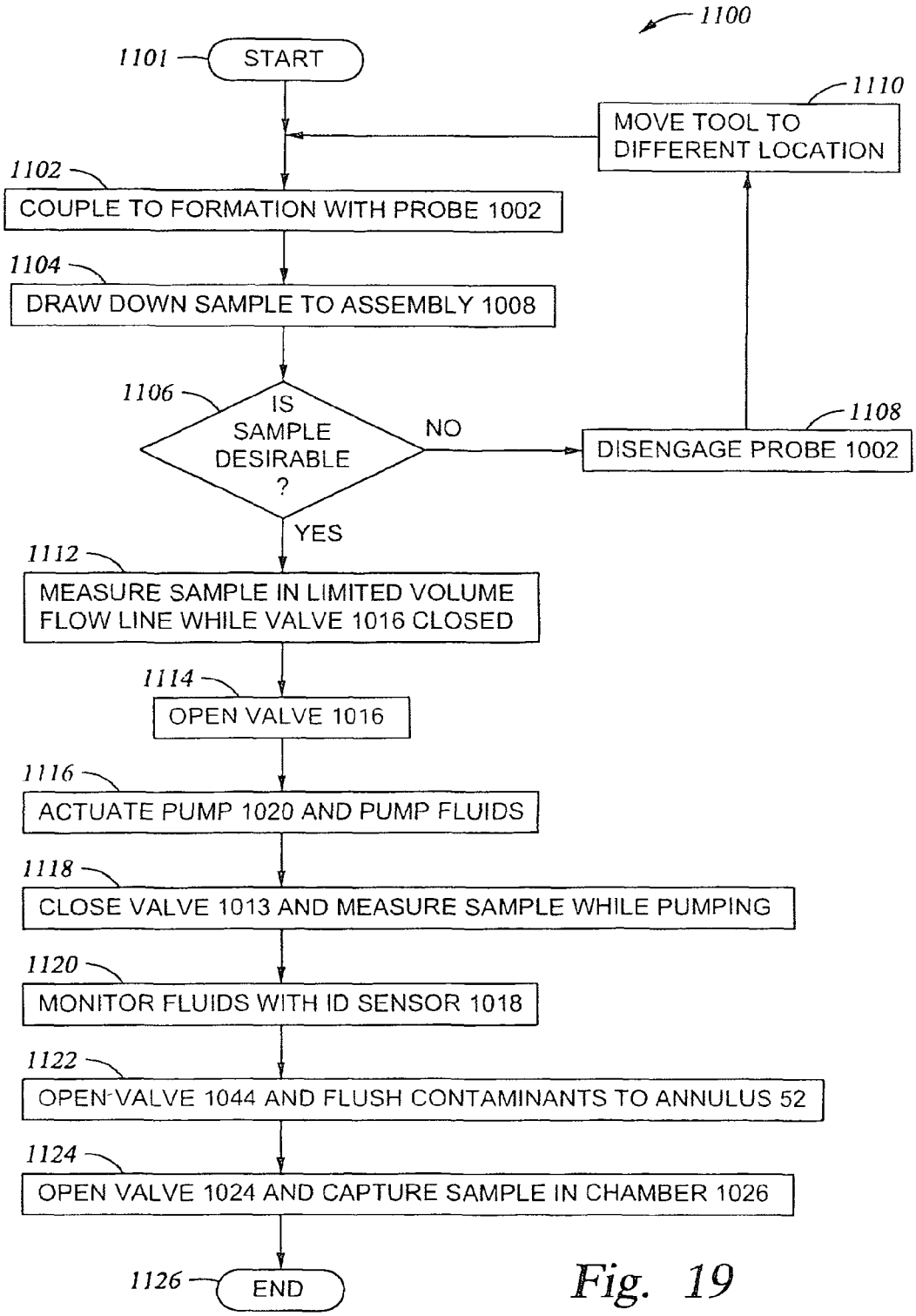
FIG. 19 is a block diagram representing exemplary method embodiments.

The block diagram of FIG. 19 represents exemplary embodiments of methods that may be performed with the tool embodiments previously described. The block diagram 1100 starts at block 1101. At block 102, and with reference to FIG. 18, the probe 1002 couples to the formation. At block 1104, a sample is drawn down to the assembly 1008. In one embodiment, the sample is detected and a decision is made whether the sample is desirable or not, at block 1106. If "NO," block 1108 includes disengaging the probe 1002, block 1110 includes moving the tool to a different location in the borehole, and the sequence is returned to block 1102 as shown. If "YES," block 1112 indicates that the sample is maintained in the limited volume flow line 1012 between the probe 1002 and the closed shut-in valve 1016. In some instances, it is valuable to measure the sample in such limited volumes. The draw down assembly 1008 and sensor 1010 may measure the sample. In other embodiments, it is desirable to open the valve 1016 and expose the sampled fluids to the increased volume of the remainder of the system 1000 of FIG. 18. This is indicated at block 1114. At block 1116, the pump 1020 is actuated to begin pumping of the sample fluids through the system. As indicated at block 1118, in another embodiment, the shut-in valve 1013 may be closed to isolate a sample fluid in the draw down assembly 1008. The isolated sample may then be measured by the sensor 1010 separately from the rest of the system and while the fluids are being pumped. An example of such an isolated test is a bubble point test, which is time dependent. As the fluids are being pumped, the fluid ID sensor 1018 monitors the fluids, as indicated at block 1120. The fluid ID sensor comprises the various direct-measurement sensors described herein. Thus, a different measurement may be taken at the fluid ID sensor 1018 than at other sensors, such as the sensor 1010. The dual action flush pump 1020 causes contaminants to separate from the target fluids, thus the valve 1044 may be opened and the contaminants may be flushed to the annulus 52, as indicated at block 1122. In another embodiment, as indicated at the block 1124, clean samples may then be captured by opening the valve 1024 and flowing the sample into the chamber 1026. Samples may also be captured in any of the other sample chambers or bottles. Although the sequence may be ended at block 1126, the sequence 1100 is an exemplary method embodiment that may include various combinations of actions described throughout the present disclosure.

The flush pump increases the tool's drawing power on the target sample fluids, thus reducing the time to obtain a good sample. Decreasing the time spent measuring fluid properties decreases the costs of the overall drilling operation as rig time is very expensive. The flush pump system also ensures cleaner sample fluids. Further, the system provides an efficient way to bottle, store and identify sample fluids.

In another embodiment, seen in FIG. 20, an alternative section of probe collar 1050 includes a first probe 1052 and a second probe 1054. The probes 1052, 1054 may include any of the various probes consistent with the teachings herein.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. An apparatus comprising:

a first drill collar section having an outer surface;

an MWD tool for interaction with an earth formation coupled to said first drill collar section, said MWD tool comprising a formation fluid line, a hydraulic fluid line and a first electrical conduit;

a second drill collar section; and an interconnect assembly coupling said second drill collar section to said first drill collar section, said interconnect assembly comprising a fluid line connection coupled to said formation fluid line and said hydraulic fluid line, and an electrical connection coupled to said first electrical conduit;

wherein said fluid line connection and said electrical connection are rotatable.

2. The apparatus of claim 1 wherein said second drill collar section is removable from said first drill collar section via said interconnect assembly.

3. The apparatus of claim 2 wherein said interconnect assembly provides electrical communication and fluid communication between said first and second drill collar sections when said first and second drill collar sections are coupled.

4. The apparatus of claim 1 wherein a drilling fluid flow bore through said interconnect assembly couples to a drilling fluid flow bore in said first drill collar.

5. The apparatus of claim 4 wherein said fluid line connection couples to a plurality of hydraulic fluid lines and said formation fluid line in said MWD tool, and said electrical connection couples to a plurality of electrical conduits in said MWD tool.

6. The apparatus of claim 1 wherein said second drill collar section comprises a power source coupled to said electrical connection and a flush pump coupled to said fluid line connection, said flush pump to continuously pump formation fluids into said MWD tool through said fluid line connection.

7. The apparatus of claim 1 further comprising a third drill collar section coupled to said second drill collar section.

8. The apparatus of claim 7 wherein said third drill collar section comprises at least one removable bottle coupled to said fluid line connection.

9. The apparatus of claim 8 further comprising a plurality of removable bottles each having an electronic identification chip.

10. The apparatus of claim 7 wherein said third drill collar section is a terminator collar, and said terminator collar is coupled to said second drill collar section by a second interconnect assembly having a second fluid line connection and a second electrical connection.

11. The apparatus of claim 10 wherein said second interconnect assembly further comprises a drilling fluid passageway and a plurality of electrical connections.

12. The apparatus of claim 10 wherein said terminator collar further comprises a fluid exit port coupled to said second fluid line connection.

13. The apparatus of claim 1 wherein said first fluid line comprises a fluid ID sensor.

14. The apparatus of claim 13 wherein said fluid ID sensor directly measures a sampled fluid property.

15. The apparatus of claim 1 wherein said electrical connection couples to a second electrical conduit at a different diameter in a radial direction from said first electrical conduit.

16. The apparatus of claim 1 wherein said interconnect assembly further comprises a removable manifold.

17. The apparatus of claim 1 wherein said MWD tool further comprises an assembly for interaction with an earth formation coupled to said first drill collar section, said assembly comprising a first member to extend beyond said first drill collar section outer surface and toward the earth formation to receive formation fluids

18. The apparatus of claim 17 wherein said assembly further comprises a second member to extend beyond said first member.

19. The apparatus of claim 18 wherein said second member couples to the earth formation.

20. The apparatus of claim 17 wherein said assembly further comprises:

a first flow line communicating with said first member;

a second member coupled to said assembly; and a second flow line communicating with said second member;

wherein said first member extends to engage the formation and define a first zone, and said first zone communicates with said first flow line, wherein said second member extends to engage the formation and define a second zone, and said second zone communicates with said second flow line.

21. The apparatus of claim 20 further comprising:

a first flow control device to control fluid flow into said first flow line; and a second flow control device to control fluid flow into said second flow line;

wherein said first control device maintains a first pressure in said first fluid flow line and said second control device maintains a second pressure in said second flow line, and said second pressure is less than or equal to said first pressure.

22. The apparatus of claim 20 wherein said first member comprises an inner snorkel tube adapted to communicate with said formation fluids and said second member comprises an outer snorkel tube adapted to communicate with borehole fluids and thereby reduce the flow of said borehole fluids into said first formation zone, said first member, and said first flow line.

23. An apparatus comprising:

a probe drill collar section having an outer surface and a probe to extend beyond said outer surface and toward an earth formation to receive formation fluids;

a power drill collar section having a power source and an electronics module;

an interconnect assembly coupling said power collar section to said probe collar section, said interconnect assembly comprising a fluid line connection rotatably coupling a formation fluid line in said power collar section to a formation fluid line in said probe collar section and a hydraulic fluid line in said power collar section to a hydraulic fluid line in said probe collar section, and an electrical connection rotatably coupling an electrical conduit in said power collar section to an electrical conduit in said probe collar section; and a sample bottle drill collar section coupled to said power collar section, said sample bottle collar section including at least one removable sample bottle in fluid communication with said probe.

24. The apparatus of claim 23 wherein said power collar section is removable from said probe collar section via said interconnect assembly.

25. The apparatus of claim 23 wherein said sample bottle is adapted to be removed on a drilling rig floor.

26. The apparatus of claim 23 further comprising a plurality of sample bottles mounted in sockets disposed radially about said sample bottle collar section.

27. The apparatus of claim 23 wherein said sample bottle includes an identification device programmable to identify said sample bottle.

28. The apparatus of claim 27 wherein said identification device is an electronic identification chip.

29. An apparatus comprising:

a probe drill collar section having an outer surface and a probe to extend beyond said outer surface and toward an earth formation to receive formation fluids;

a power drill collar section having a power source and an electronics module;

an interconnect assembly coupling said power collar section to said probe collar section, said interconnect assembly comprising a fluid line connection rotatably coupling a formation fluid line in said power collar section to a formation fluid line in said probe collar section and a hydraulic fluid line in said power collar section to a hydraulic fluid line in said probe collar section, and an electrical connection rotatably coupling an electrical conduit in said power collar section to an electrical conduit in said probe collar section; and a flush pump mounted in said power collar section and coupled to said probe.

30. The apparatus of claim 29 wherein said flush pump is adapted to continuously pump formation fluids into said probe.

31. The apparatus of claim 29 wherein said flush pump is a dual action pump.

32. The apparatus of claim 29 further comprising:

a terminator drill collar section coupled to said power collar section and having a fluid exit port; and a fluid flow line coupling said flush pump to said fluid exit port to communicate fluids from said flush pump to an annulus.

33. The apparatus of claim 29 further comprising a fluid ID sensor disposed in a flow line between said flush pump and said probe to directly measure a fluid therein.

34. The apparatus of claim 29 wherein said power collar section is removable from said probe collar section via said interconnect assembly.

35. A method of sampling a formation fluid comprising:

flowing a formation fluid into a first flow line;

measuring a first property of the formation fluid;

opening a first valve to expose the formation fluid to a second flow line;

pumping the formation fluid with a pump disposed in the second flow line; and directly measuring a second property of the formation fluid with a fluid ID sensor.

36. The method of claim 35 further comprising:

closing a second valve while pumping to isolate a portion of the formation fluid; and measuring a third property of the isolated formation fluid.

37. The method of claim 35 further comprising:

skimming contaminants from the formation fluid by pumping; and flushing the contaminants from the second flow line.

38. The method of claim 35 further comprising:

capturing the formation fluid in a sample bottle.

* * * * *